US012179889B2

(12) United States Patent
Krosschell et al.

(10) Patent No.: US 12,179,889 B2
(45) Date of Patent: Dec. 31, 2024

(54) BOAT MANEUVERABILITY AND STABILITY CONTROL SYSTEMS AND METHODS

(71) Applicant: Polaris Industries Inc., Medina, MN (US)

(72) Inventors: Brian D. Krosschell, North Branch, MN (US); Blair A. Donat, Elkhart, IN (US); Louis J. Brady, Chisago City, MN (US); Patrick D. Weldon, Roseville, MN (US); Bradley R. Fishburn, Nappanee, IN (US); Chiao George Liu, White Bear Lake, MN (US); Michael F. Donoughe, Rochester, MI (US); Aidan B. Shaughnessy, Madison, AL (US)

(73) Assignee: Polaris Industries Inc., Medina, MN (US)

( * ) Notice: Subject to any disclaimer, the term of this patent is extended or adjusted under 35 U.S.C. 154(b) by 556 days.

(21) Appl. No.: 17/368,538

(22) Filed: Jul. 6, 2021

(65) Prior Publication Data

US 2022/0001962 A1 Jan. 6, 2022

Related U.S. Application Data

(60) Provisional application No. 63/048,320, filed on Jul. 6, 2020.

(51) Int. Cl.

| | |
|---|---|
| ***B63B 35/38*** | (2006.01) |
| ***B63B 1/12*** | (2006.01) |
| ***B63B 49/00*** | (2006.01) |
| ***B63B 79/10*** | (2020.01) |
| ***B63H 20/10*** | (2006.01) |
| ***B63H 20/12*** | (2006.01) |

(52) U.S. Cl.

CPC ..... *B63B 35/38* (2013.01); *B63B 1/121* (2013.01); *B63B 49/00* (2013.01); *B63B 79/10* (2020.01); *B63H 20/10* (2013.01); *B63H 20/12* (2013.01)

(58) Field of Classification Search

CPC ..... B63B 35/38; B63B 79/10; B63B 1/121; B63B 49/00; B63H 20/10; B63H 20/12

See application file for complete search history.

(56) References Cited

U.S. PATENT DOCUMENTS

| | | | |
|---|---|---|---|
| 4,056,073 | A | 11/1977 | Dashew et al. |
| 5,172,324 | A | 12/1992 | Knight |
| 5,259,331 | A | 11/1993 | Hagan |

(Continued)

FOREIGN PATENT DOCUMENTS

| | | | |
|---|---|---|---|
| CA | 2396479 | A1 | 10/2003 |
| CN | 104276265 | A | 1/2015 |

(Continued)

OTHER PUBLICATIONS

Evinrude unveils $5,999 iDock joystick piloting system, Boating Industry, dated Jul. 10, 2017; 4 pages.

(Continued)

*Primary Examiner* — Stephen P Avila

(74) *Attorney, Agent, or Firm* — Faegre Drinker Biddle & Reath LLP

(57) ABSTRACT

Boat handling and control systems and methods related to one or more of steering and propulsion of a pontoon boat.

30 Claims, 13 Drawing Sheets

(56) References Cited

U.S. PATENT DOCUMENTS 5,502,587 A 3/1996 Frigo
6,142,841 A 11/2000 Alexander et al.
6,249,241 B1 6/2001 Jordan et al.
6,325,683 B1 12/2001 Yocom
6,434,512 B1 8/2002 Discenzo
6,439,941 B2 8/2002 McClure et al.
6,469,664 B1 10/2002 Michaelson et al.
6,581,537 B2 6/2003 McBride et al.
6,734,808 B1 5/2004 Michaelson et al.
7,182,033 B1 2/2007 Phillips et al.
7,185,599 B1 3/2007 Griffiths et al.
7,315,779 B1 1/2008 Rioux et al.
7,380,538 B1 6/2008 Gagnon et al.
7,416,458 B2 8/2008 Suemori
7,530,345 B1 5/2009 Plante et al.
7,836,787 B2 11/2010 Oguma
7,841,915 B2 11/2010 Bourret et al.
7,900,510 B1 3/2011 O'Brien
7,950,340 B1 5/2011 Curtis
8,066,538 B1 11/2011 Kostrzewski
8,146,524 B1 4/2012 Cote et al.
8,177,594 B2 5/2012 Dagenais et al.
8,202,136 B2 6/2012 Dagenais et al.
8,441,956 B2 5/2013 Misumi et al.
8,589,004 B1 11/2013 Kanno
8,622,778 B2 1/2014 Tyers et al.
8,645,012 B2 2/2014 Salmon
8,725,312 B2 5/2014 Mori et al.
8,753,154 B2 6/2014 Fujino et al.
8,818,587 B1 8/2014 Arbuckle
8,924,054 B1 12/2014 Arbuckle
8,965,606 B2 2/2015 Mizutani
9,108,710 B1 8/2015 Mcchesney et al.
9,248,895 B1 2/2016 Gendron et al.
9,376,189 B1 6/2016 De et al.
9,517,826 B1 12/2016 Leblond
9,682,757 B1 6/2017 Bourret
9,738,364 B2 8/2017 Abney
9,778,657 B2 10/2017 Tyers
10,065,721 B1 9/2018 Girard et al.
10,272,977 B2 4/2019 Hashizume et al.
10,281,917 B2 5/2019 Tyers
10,377,458 B1 8/2019 McGinley
10,556,642 B1 2/2020 Massicotte et al.
10,723,429 B1 7/2020 Wiatrowski et al.
10,871,775 B2 12/2020 Hashizume et al.
11,046,406 B1 6/2021 Kunanec et al.
11,208,188 B2 12/2021 Fishburn et al.
11,348,191 B2 5/2022 Tian et al.
11,390,262 B2 7/2022 Brandt et al.
11,427,284 B1 8/2022 Lieb
11,618,537 B2 4/2023 Schmid et al.
2002/0129410 P1 9/2002 Amorao et al.
2003/0137445 A1 7/2003 Van Rees et al.
2004/0222902 A1 11/2004 Wortsmith
2005/0181687 A1* 8/2005 Okumura ..... B63H 25/02 440/53
2005/0272322 A1 12/2005 Mizuguchi et al.
2006/0228959 A1 10/2006 Ruiz
2007/0227429 A1 10/2007 Okuyama et al.
2007/0249244 A1 10/2007 Watanabe et al.
2007/0276563 A1 11/2007 Kaji
2008/0038967 A1 2/2008 Shinde et al.
2008/0119094 A1* 5/2008 Mizutani ..... B63H 20/12 440/53
2008/0254689 A1 10/2008 Kaji
2009/0101056 A1 4/2009 Waldo
2009/0107377 A1 4/2009 Duquette et al.
2009/0107379 A1 4/2009 Duquette et al.
2009/0107380 A1 4/2009 Duquette et al.
2009/0139437 A1 6/2009 Simard et al.
2009/0176418 A1 7/2009 Mizutani
2009/0224132 A1 9/2009 Mochizuki
2009/0227157 A1 9/2009 Mochizuki
2009/0264029 A1 10/2009 Dagenais et al.
2010/0041286 A1 2/2010 Bourret et al.
2010/0114412 A1 5/2010 Mizutani
2010/0178815 A1 7/2010 Leblanc
2010/0240266 A1 9/2010 Shibayama et al.
2010/0256845 A1 10/2010 Mizutani et al.
2010/0267296 A1 10/2010 Kuriyagawa et al.
2011/0217886 A1 9/2011 Kuriyagawa et al.
2011/0217888 A1 9/2011 Kuriyagawa et al.
2011/0223815 A1 9/2011 Kinoshita
2011/0294370 A1 12/2011 Kuriyagawa et al.
2012/0021659 A1 1/2012 Ota
2012/0025965 A1 2/2012 Mochizuki et al.
2012/0129410 A1 5/2012 Tyers
2013/0316603 A1 11/2013 Hagi
2014/0158037 A1 6/2014 George
2014/0220837 A1 8/2014 Kuriyagawa et al.
2014/0295717 A1 10/2014 Kuriyagawa et al.
2014/0349530 A1 11/2014 Mochizuki et al.
2014/0364019 A1 12/2014 Ito et al.
2015/0086373 A1 3/2015 Kaneko et al.
2015/0089427 A1 3/2015 Akuzawa
2016/0003636 A1 1/2016 Ng-Thow-Hing et al.
2016/0011000 A1 1/2016 Vanderburgh
2016/0059855 A1 3/2016 Rebhan et al.
2016/0176409 A1 6/2016 Kirsch et al.
2016/0187883 A1 6/2016 Tyers et al.
2016/0318445 A1 11/2016 Sugimoto
2016/0375974 A1 12/2016 Loftus et al.
2017/0137103 A1 5/2017 Ito
2017/0152012 A1 6/2017 Vachon
2017/0205829 A1 7/2017 Tyers
2017/0268896 A1 9/2017 Bai et al.
2017/0277192 A1 9/2017 Gupta et al.
2017/0369055 A1 12/2017 Saigusa et al.
2018/0004209 A1 1/2018 Akuzawa et al.
2018/0017974 A1 1/2018 Tyers
2018/0037227 A1 2/2018 Dsa et al.
2018/0134354 A1 5/2018 Suzuki et al.
2018/0151009 A1 5/2018 Kim et al.
2018/0283874 A1 10/2018 Hashizume et al.
2018/0286251 A1 10/2018 Fujima et al.
2018/0288821 A1 10/2018 Kanayama et al.
2018/0345994 A1 12/2018 Goerick
2019/0019352 A1 1/2019 Harper
2019/0048639 A1 2/2019 Lickfelt et al.
2019/0071160 A1 3/2019 Bylsma
2019/0233074 A1 8/2019 Wiatrowski et al.
2020/0001953 A1 1/2020 Vachon et al.
2020/0026293 A1 1/2020 Hashizume et al.
2020/0042013 A1 2/2020 Kelkar et al.
2020/0064466 A1 2/2020 Harper et al.
2020/0086879 A1 3/2020 Lakshmi et al.
2020/0089969 A1 3/2020 Lakshmi et al.
2020/0156751 A1 5/2020 Skrzypchak et al.
2020/0252775 A1 8/2020 Morschhauser et al.
2020/0301437 A1 9/2020 Misu et al.
2020/0312155 A1 10/2020 Kelkar et al.
2020/0385097 A1 12/2020 Donat et al.
2021/0061431 A1 3/2021 Mcginley et al.
2021/0065224 A1 3/2021 Kawashima
2021/0086875 A1 3/2021 Nakatani
2021/0094661 A1 4/2021 Schmid et al.
2021/0094665 A1 4/2021 Fuchs et al.
2021/0129954 A1 5/2021 Inoue
2021/0141396 A1 5/2021 Kinoshita
2021/0155333 A1 5/2021 Mizutani
2021/0188406 A1 6/2021 Nakatani
2021/0229791 A1 7/2021 Inoue
2021/0250737 A1 8/2021 Herga et al.
2021/0263513 A1 8/2021 Liu et al.
2021/0293545 A1 9/2021 Zhang et al.
2021/0335060 A1 10/2021 Bauer et al.
2021/0380210 A1 12/2021 Fishburn et al.
2022/0048513 A1 2/2022 Xu et al.
2022/0169339 A1 6/2022 Jaziri et al.
2022/0177087 A1 6/2022 Amma et al.
2022/0177088 A1 6/2022 Amma
2022/0234701 A1 7/2022 Suda
2022/0306256 A1 9/2022 Ohiso

(56) References Cited

U.S. PATENT DOCUMENTS

| | | | |
|---|---|---|---|
| 2022/0306257 | A1 | 9/2022 | Afman et al. |
| 2022/0308576 | A1 | 9/2022 | Judson et al. |
| 2022/0317857 | A1 | 10/2022 | Tarchala et al. |
| 2022/0332303 | A1 | 10/2022 | Bernatchez et al. |
| 2022/0371700 | A1 | 11/2022 | Hall et al. |
| 2022/0371715 | A1 | 11/2022 | Ito |
| 2022/0383646 | A1 | 12/2022 | Hosoya et al. |
| 2023/0008091 | A1 | 1/2023 | Tsubone et al. |
| 2023/0012090 | A1 | 1/2023 | Tsubone et al. |
| 2023/0049367 | A1 | 2/2023 | Endrizzi et al. |
| 2023/0168678 | A1 | 6/2023 | Kameyama et al. |
| 2023/0373606 | A1 | 11/2023 | Fishburn et al. |

FOREIGN PATENT DOCUMENTS

| | | | |
|---|---|---|---|
| CN | 109285389 | A | 1/2019 |
| ES | 2046117 | A2 | 1/1994 |
| JP | 59-073387 | A | 4/1984 |
| JP | 61-282193 | A | 12/1986 |
| JP | 05-065098 | A | 3/1993 |
| JP | 06-227478 | A | 8/1994 |
| JP | 07-047992 | A | 2/1995 |
| JP | 08-029745 | A | 2/1996 |
| JP | 08-032523 | A | 2/1996 |
| JP | 08-032524 | A | 2/1996 |
| JP | 08-032525 | A | 2/1996 |
| JP | 08-032528 | A | 2/1996 |
| JP | 08-284705 | A | 10/1996 |
| JP | 08-284725 | A | 10/1996 |
| JP | 08-284726 | A | 10/1996 |
| JP | 09-053500 | A | 2/1997 |
| JP | 09-301279 | A | 11/1997 |
| JP | 10-218084 | A | 8/1998 |
| JP | 2836738 | B2 | 12/1998 |
| JP | 2898502 | B2 | 6/1999 |
| JP | 2000-038195 | A | 2/2000 |
| JP | 2001-287693 | A | 10/2001 |
| JP | 3305522 | B2 | 7/2002 |
| JP | 3410867 | B2 | 5/2003 |
| JP | 3523711 | B2 | 4/2004 |
| JP | 2004-178574 | A | 6/2004 |
| JP | 3672133 | B2 | 7/2005 |
| JP | 2006-036008 | A | 2/2006 |
| JP | 3744961 | B2 | 2/2006 |
| JP | 3745406 | B2 | 2/2006 |
| JP | 2006-160214 | A | 6/2006 |
| JP | 2006-219002 | A | 8/2006 |
| JP | 3939777 | B2 | 7/2007 |
| JP | 4791340 | B2 | 10/2011 |
| JP | 2012-096774 | A | 5/2012 |
| JP | 2015-068831 | A | 4/2015 |
| JP | 2015-069656 | A | 4/2015 |
| KR | 10-2016-0006943 | A | 1/2016 |
| WO | 2005/030574 | A1 | 4/2005 |
| WO | 2016/166620 | A1 | 10/2016 |
| WO | 2018/232376 | A1 | 12/2018 |
| WO | 2019/081019 | A1 | 5/2019 |
| WO | 2021/075319 | A1 | 4/2021 |

OTHER PUBLICATIONS

Faria Marine Instruments Owner's Manual; 4 pages, Nov. 2003.

Hummingbird.com, 2019 Hummingbird Products brochure; 40 pages.

International Preliminary Report on Patentability received for PCT Patent Application No. PCT/US2020/052973, mailed on Apr. 7, 2022, 8 pages.

International Search Report and Written Opinion issued by the International Searching Authority, dated Dec. 21, 2020, for International Patent Application No. PCT/US2020/052973; 17 pages.

International Search Report and Written Opinion, issued by the International Searching Authority, dated Dec. 21, 2020, for International Patent Application No. 3; 9 pages.

Office Action issued by the Canadian Intellectual Property Office, dated Aug. 10, 2021, for Canadian Patent Application No. 3,082,689; 6 pages.

European Search Report for EP Patent Application No. 20870163.1, Issued on Nov. 29, 2023, 9 pages.

International Search Report and Written Opinion received for PCT Patent Application No. PCT/US20/52973, mailed on Dec. 21, 2020, 16 pages.

* cited by examiner

BOAT MANEUVERABILITY AND STABILITY CONTROL SYSTEMS AND METHODS

RELATED APPLICATION

This application claims the benefit of U.S. Provisional Application No. 63/048,320, filed Jul. 6, 2020, titled BOAT MANEUVERABILITY AND STABILITY CONTROL SYSTEMS AND METHODS, the entire disclosure of which is expressly incorporated by reference herein.

BACKGROUND AND SUMMARY OF THE DISCLOSURE

The present disclosure relates to improved boat handling and control systems and methods and, in particular, to boat handling and control systems and methods for one or more of steering and propulsion.

Pontoon boats are known having multiple outboard motors for propelling the pontoon boat and steering the boat. Operator controls are provided to control a thrust demand input to the motors, a steering direction of the motors, and a trim level of the motors.

The present disclosure relates to embodiments of systems and methods to control one or more characteristics of a propulsion system of a pontoon boat to improve the maneuverability and stability of the pontoon boat.

In an exemplary embodiment of the present disclosure, a pontoon boat for navigation on water is provided. The pontoon boat comprising a plurality of water support members including at least a first water support member and a second water support member spaced apart from the first water support member; a frame supported by the plurality of water support members; a water propulsion system coupled to the frame to propel the boat through the water, the water propulsion system including a plurality of moveable motors, each of the plurality of moveable motors has an adjustable torque output and an adjustable thrust direction; an operator interface including an operator steering input, a thrust demand input; at least one sensor supported by the plurality water support members to monitor a movement characteristic of the pontoon boat through the water; and an electronic controller operatively coupled to the at least one sensor, the operator interface, and the water propulsion system. The electronic controller altering at least one of the adjustable torque and the adjustable thrust direction of at least one of the plurality of moveable motors based on at least one of the operator steering input and the thrust demand input and the movement characteristic monitored by the at least one sensor.

In an example thereof, each of the plurality of moveable motors further has an adjustable trim level and the electronic controller further altering the adjustable trim level based on at least one of a trim input of the operator interface, the operator steering input and the thrust demand input, and the movement characteristic monitored by the at least one sensor, and an adjustable trim level In another example thereof, the electronic controller alters the at least one of the adjustable torque output and the adjustable thrust direction of at least one of the plurality of moveable motors based on a predicted movement of the pontoon boat.

In a further example thereof, the movement characteristic is an acceleration characteristic of the pontoon boat. In a variation thereof, the acceleration characteristic is an angular acceleration characteristic. In another variation thereof, the acceleration characteristic is a linear acceleration characteristic.

In a still further example thereof, the movement characteristic is a longitudinal speed of the pontoon boat and the electronic controller adjusts a steering ratio of a movement of the steering input of the operator interface to the resultant movement of a steering actuator of at least one of the plurality of moveable motors of the water propulsion system based on the longitudinal speed of the pontoon boat. In a variation thereof, the electronic controller alters a torque output of at least one of the plurality of moveable engines based on a first steering value from the steering input. In another variation thereof, the plurality of movable motors includes a port outboard motor positioned at a stern of the pontoon boat and a starboard outboard motor positioned at the stern of the pontoon boat and the electronic controller lowers a torque output of the port outboard motor when the first steering value from the steering input indicates a turn to port. In a further variation thereof, the pontoon boat further comprises at least one camera and the operator interface includes a display and the electronic controller in response to the first steering value from the steering input indicating the turn to port displays an output from the at least one camera showing a view including the water from a port side of the pontoon boat on the display.

In another still example thereof, the movement characteristic is a lateral acceleration of the pontoon boat and the electronic controller adjusts a steering ratio of a movement of the steering input of the operator interface to the resultant movement of a steering actuator of at least one of the plurality of moveable motors of the water propulsion system based on the lateral acceleration of the pontoon boat.

In a further still example thereof, the movement characteristic is a magnitude of a roll angle about a longitudinal axis of the pontoon boat.

In yet a further still example thereof, the movement characteristic is a magnitude of a pitch angle about a lateral axis of the pontoon boat.

In another example thereof, in response to at least one input from the operator interface resulting in an unstable movement dynamic for the pontoon boat, the electronic controller provides feedback to the operator through the operator interface. In a variation thereof, the feedback includes a visual representation on a display of the operator interface. In another variation thereof, the feedback includes a tactile feedback. In a further variation thereof, the feedback includes an audio feedback. In still a further variation thereof, the electronic controller alters the at least one of the adjustable torque output, the adjustable thrust direction, and an adjustable trim level of at least one of the plurality of moveable motors to provide a stable movement dynamic for the pontoon boat.

In a further example thereof, the operator interface further includes a mode input and the electronic controller alters the at least one of the adjustable torque output, the adjustable thrust direction, and the adjustable trim level of at least one of the plurality of moveable motors based on a selected operation mode of the pontoon boat.

In still a further example thereof, the electronic controller determines an estimated center of gravity of the pontoon boat and alters the at least one of the adjustable torque output, the adjustable thrust direction, and an adjustable trim level of at least one of the plurality of moveable motors based on the estimated center of gravity of the pontoon boat.

In another example thereof, the operator interface includes at least one input to receive a weight distribution characteristic of the pontoon boat and the electronic controller alters the at least one of the adjustable torque output, the adjustable thrust direction, and an adjustable trim level of at least one of the plurality of moveable motors based on the weight distribution characteristic.

In yet another example thereof, the electronic controller alters the at least one of the adjustable torque output, the adjustable thrust direction, and an adjustable trim level of at least one of the plurality of moveable motors based on an orientation characteristic In a further still example thereof, a width of the pontoon boat is up to 10 feet.

In another exemplary embodiment of the present disclosure, a method of operating a pontoon boat for navigation on water is provided. The method comprising the steps of: supporting an accelerometer on the pontoon boat; and altering an output of a propulsion system of the pontoon boat based on an output of the accelerometer supported by the pontoon boat.

In an example thereof, the accelerometer provides a lateral acceleration of the pontoon boat along an axis intersecting a port side of the pontoon boat and a starboard side of the pontoon boat, the output of the propulsion system of the pontoon boat being altered based on the lateral acceleration indicated by the accelerometer supported by the pontoon boat.

In another example thereof, the accelerometer provides a longitudinal acceleration of the pontoon boat along an axis intersecting a bow of the pontoon boat and a stern of the pontoon boat, the output of the propulsion system of the pontoon boat being altered based on the longitudinal acceleration indicated by the accelerometer supported by the pontoon boat.

In a further example thereof, the accelerometer provides a longitudinal acceleration of the pontoon boat along an axis intersecting a bow of the pontoon boat and a stern of the pontoon boat, the output of the propulsion system of the pontoon boat being altered based on the longitudinal acceleration indicated by the accelerometer supported by the pontoon boat.

In a still further exemplary embodiment of the present disclosure, a method of operating a pontoon boat for navigation on water is provided. The method comprising the steps of: powering movement of the pontoon boat simultaneously with a first number of motors, the first number being at least two; detecting at least one characteristic of a first one of the first number of motors; based on the detected at least one characteristic of the first one of the first number of motors, powering movement of the pontoon boat with a second number of motors; and controlling at least one of a trim, a steer angle, and a thrust demand for the second number of motors to maintain a desired course of the pontoon boat.

In a still further exemplary embodiment of the present disclosure, a method of operating a pontoon boat for navigation on water is provided. The method comprising the steps of: powering movement of the pontoon boat simultaneously with a first number of motors, the first number being at least two; detecting at least one characteristic a power source of the pontoon boat; based on the detected at least one characteristic of the power source, powering movement of the pontoon boat with a second number of motors, the second number being less than the first number; and controlling at least one of a trim, a steer angle, and a thrust demand for the second number of motors to maintain a desired course of the pontoon boat.

In a still further exemplary embodiment of the present disclosure, a method of operating a pontoon boat for navigation on water is provided. The method comprising the steps of: powering movement of the pontoon boat simultaneously with a first number of motors, the first number being at least two; detecting at least one characteristic a power source of the pontoon boat; determining a distance to a power supply location; determining with an electronic controller an estimated range of the boat when powered by the first number of motors; based on a comparison of the estimated range and the distance, powering movement of the pontoon boat with a second number of motors, the second number being less than the first number.

Additional features of the present disclosure will become apparent to those skilled in the art upon consideration of the following detailed description of illustrative embodiments exemplifying the best mode of carrying out the invention as presently perceived.

BRIEF DESCRIPTION OF THE DRAWINGS

The foregoing aspects and many additional features of the present system and method will become more readily appreciated and become better understood by reference to the following detailed description when taken in conjunction with the accompanying drawings.

Figure 1:
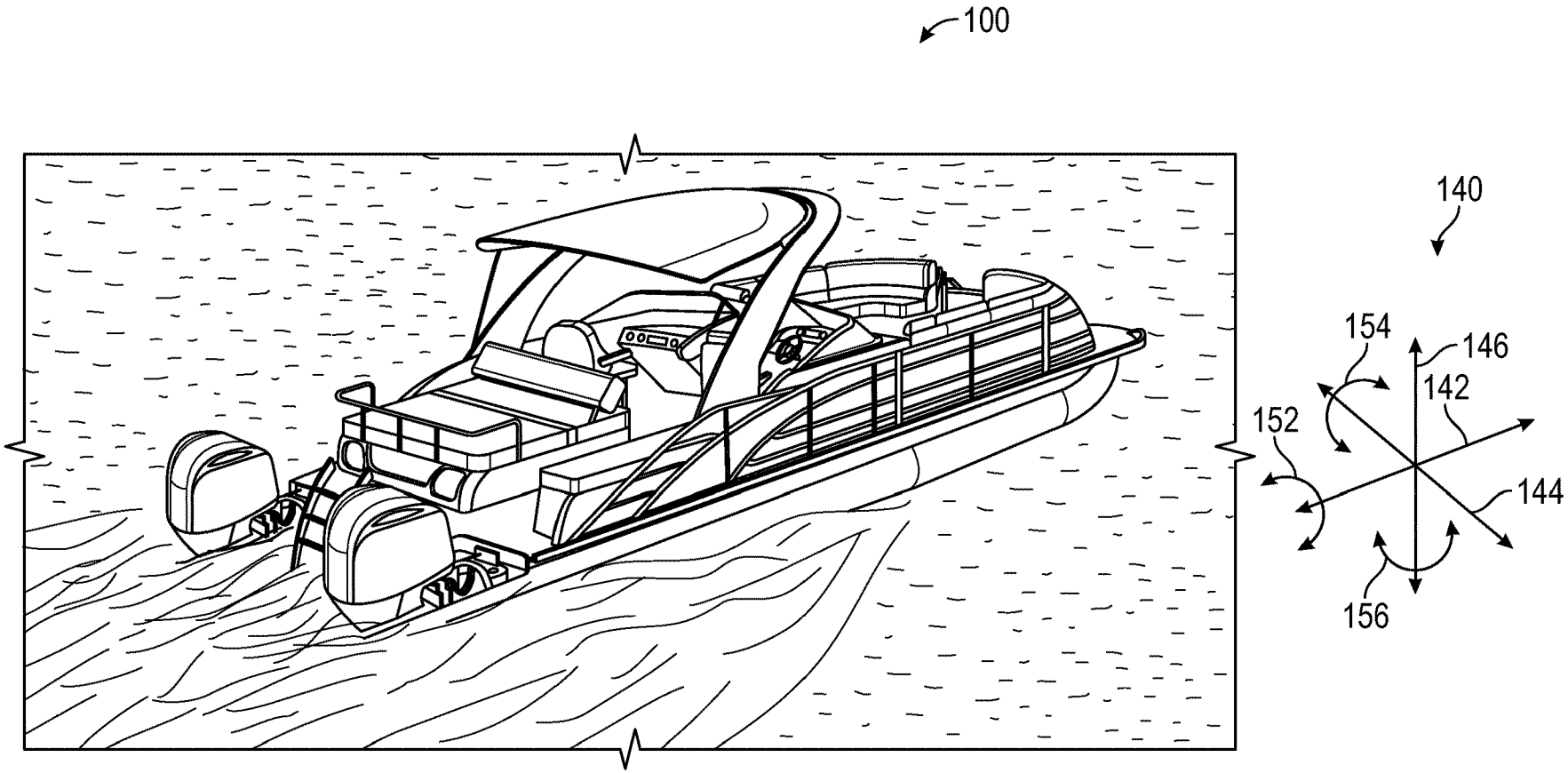
FIG. 1 illustrates an exemplary pontoon boat traveling through the water.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure.

DETAILED DESCRIPTION OF THE DRAWINGS

For the purposes of promoting an understanding of the principles of the present disclosure, reference will now be made to the embodiments illustrated in the drawings, which are described below. The embodiments disclosed below are not intended to be exhaustive or limited to the precise form disclosed in the following detailed description. Rather, the embodiments are chosen and described so that others skilled in the art may utilize their teachings.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

Figure 2:
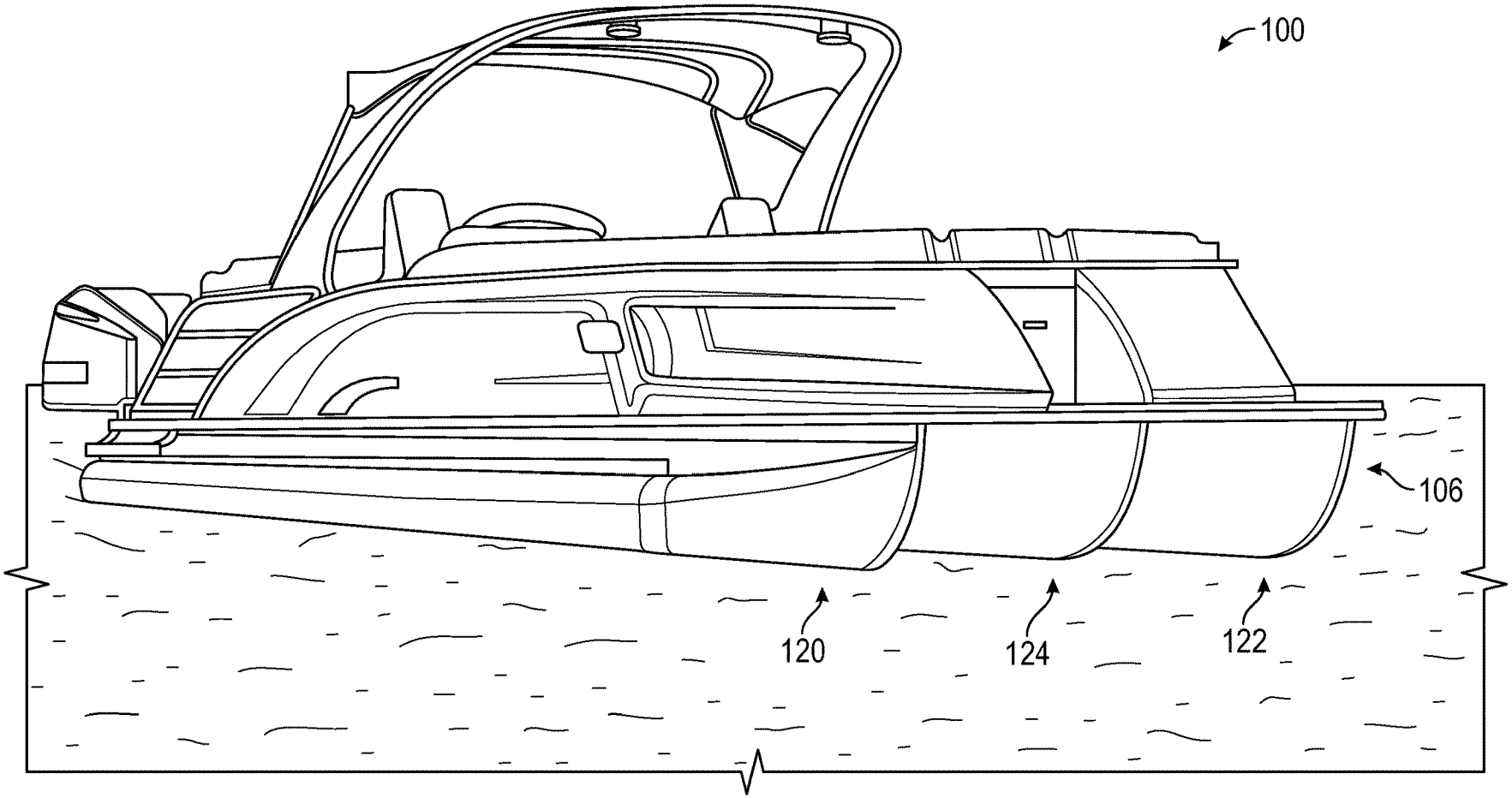
FIG. 2 illustrates the pontoon boat of FIG. 1 stationary in the water.
Figure 3:
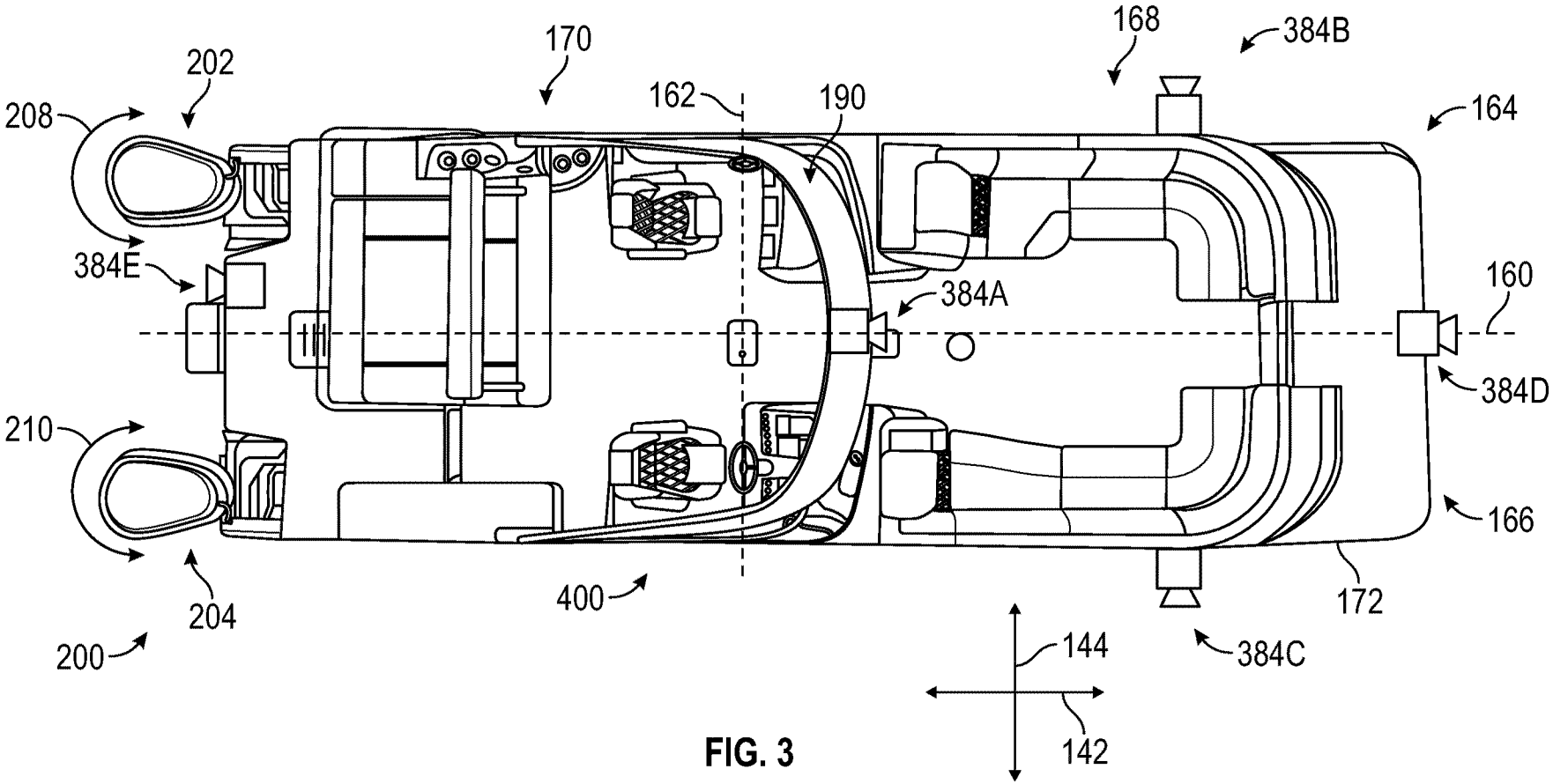
FIG. 3 illustrates a top view of the pontoon boat of FIG. 1.

Referring to FIGS. 1-3, an exemplary pontoon boat 100 is floating in a body of water 10 having a top surface 12. Pontoon boat 100 includes a deck 104 supported by a plurality of pontoons 106. The deck supports a railing 108 including a gate 110 positioned in a bow portion 112 of pontoon boat 100. Pontoon boat 100 may further include a plurality of seats 114, a canopy support 116, and other components supported by deck 104.

The plurality of pontoons 106 include a starboard pontoon 120, a port pontoon 122, and a central pontoon 124. Each of starboard pontoon 120, port pontoon 122, and central pontoon 124 support deck 104 through respective brackets (not shown). Each of starboard pontoon 120, port pontoon 122, and central pontoon 124 support deck 104 above top surface 12 of water 10. Although three pontoons are illustrated, the plurality of pontoons 106 may be limited to two pontoons or have four or more pontoons. Further, although the plurality of pontoons 106 are illustrated as running a full length of pontoon boat 100, in embodiments, one or more of plurality of pontoons 106 are divided into a bow portion pontoon and a stern portion pontoon.

Referring to FIGS. 1 and 3, a position of pontoon boat 100 is described in relation to a coordinate system 140 having a longitudinal axis 142, a lateral axis 144, and a vertical axis 146 and in relation to a roll rotation 152 about longitudinal axis 142, a pitch rotation 154 about lateral axis 144, and a yaw rotation 156 about vertical axis 146. As pontoon boat 100 travels through water 10, a position of pontoon boat 100 relative to longitudinal axis 142, lateral axis 144, and/or vertical axis 146 is altered and an angular pose of pontoon boat 100 in water 10 based on roll rotation 152, pitch rotation 154, and/or yaw rotation 156 may be altered.

Referring to FIG. 3, pontoon boat 100 has a longitudinal centerline 160 and a lateral centerline 162. Longitudinal centerline 160 divides pontoon boat 100 into a port side 164 of pontoon boat 100 and a starboard side 166 of pontoon boat 100. Lateral centerline 162 divides pontoon boat 100 into a bow portion 168 of pontoon boat 100 and a stern portion 170 of pontoon boat 100. Deck 104 of pontoon boat 100 includes an outer perimeter 172.

The movement of pontoon boat 100 is controlled by a propulsion system 200. Propulsion system 200 illustratively includes a port side outboard motor 202 which extends beyond outer perimeter 172 of deck 104 at the stern of pontoon boat 100 and a starboard side outboard motor 204 which extends beyond outer perimeter 172 of deck 104 at the stern of pontoon boat 100. In embodiments, port side outboard motor 202 and starboard side outboard motor 204 do not extend beyond outer perimeter 172 of deck 104, but rather are located under deck 104. In embodiments, port side outboard motor 202 and starboard side outboard motor 204 are internal combustion engines which power rotation of an propeller 212 (see FIG. 4). The propeller may be rotated in a first direction to provide a forward thrust to pontoon boat 100 or in a second direction, opposite the first direction, to provide a rearward thrust to pontoon boat 100. In embodiments, the propellers of each of port side outboard motor 202 and starboard side outboard motor 204 are rotated in the same direction, such as both in the first direction, or in opposite directions, such as port side outboard motor 202 in the first direction and starboard side outboard motor 204 in the second direction to cause a rotation of pontoon boat 100 about vertical axis 146. Further, each of port side outboard motor 202 and starboard side outboard motor 204 are rotatably mounted to one of plurality of pontoons 106 and deck 104 to rotate in directions 208 and 210, respectively, through mounts 214 (see FIG. 4) such that an orientation of the propeller may be adjusted to turn pontoon boat 100 about vertical axis 146 and to rotate upward or downward in direction 216 (see FIG. 4) to adjust a trim of propulsion system 200. Exemplary mounts are provided on the BENNINGTON brand 27 QXSBWA x2 model available from Polaris Industries Inc located at 2100 Hwy. 55 in Medina, Minn. 55340 Medina Minn. In embodiments, a single outboard engine may be provided or more than two outboard engines are provided. In embodiments, pontoon boat 100 includes adjustable trim tabs which may be adjusted to alter a trim level of pontoon boat 100.

Figure 5:
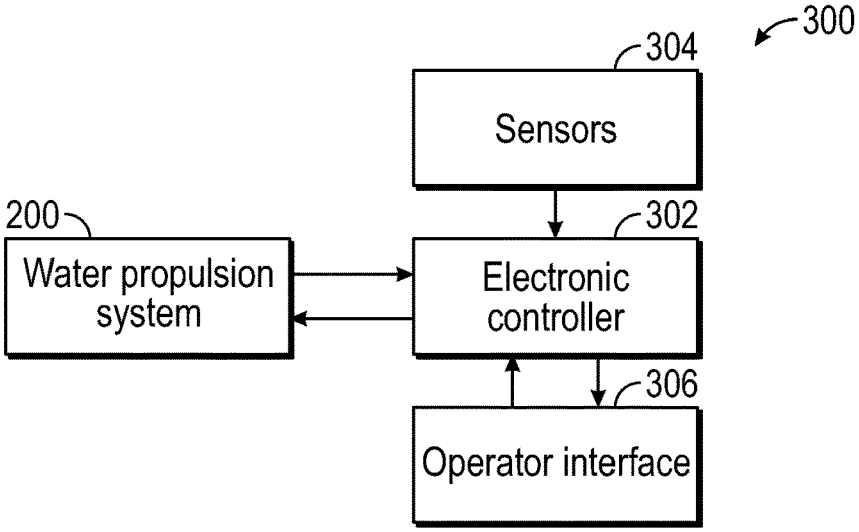
FIG. 5 illustrates an exemplary control system of the pontoon boat of FIG. 1.

Referring to FIG. 5, a control system 300 for pontoon boat 100 is illustrated. Control system 300 includes an electronic controller 302 which is operatively coupled to propulsion system 200 to control the operation of propulsion system 200. Electronic controller 302 provides control instructions to propulsion system 200 based on input from one or more sensors 304 and/or inputs received through an operator interface 306. In embodiments, based upon the input itself or monitoring a system result of the input, such as a position of a steering input of the operator interface or an angle of the outboard motor relative to a longitudinal axis of the pontoon boat, the electronic controller 302 provides control instructions to the propulsion system 200.

Figure 6:
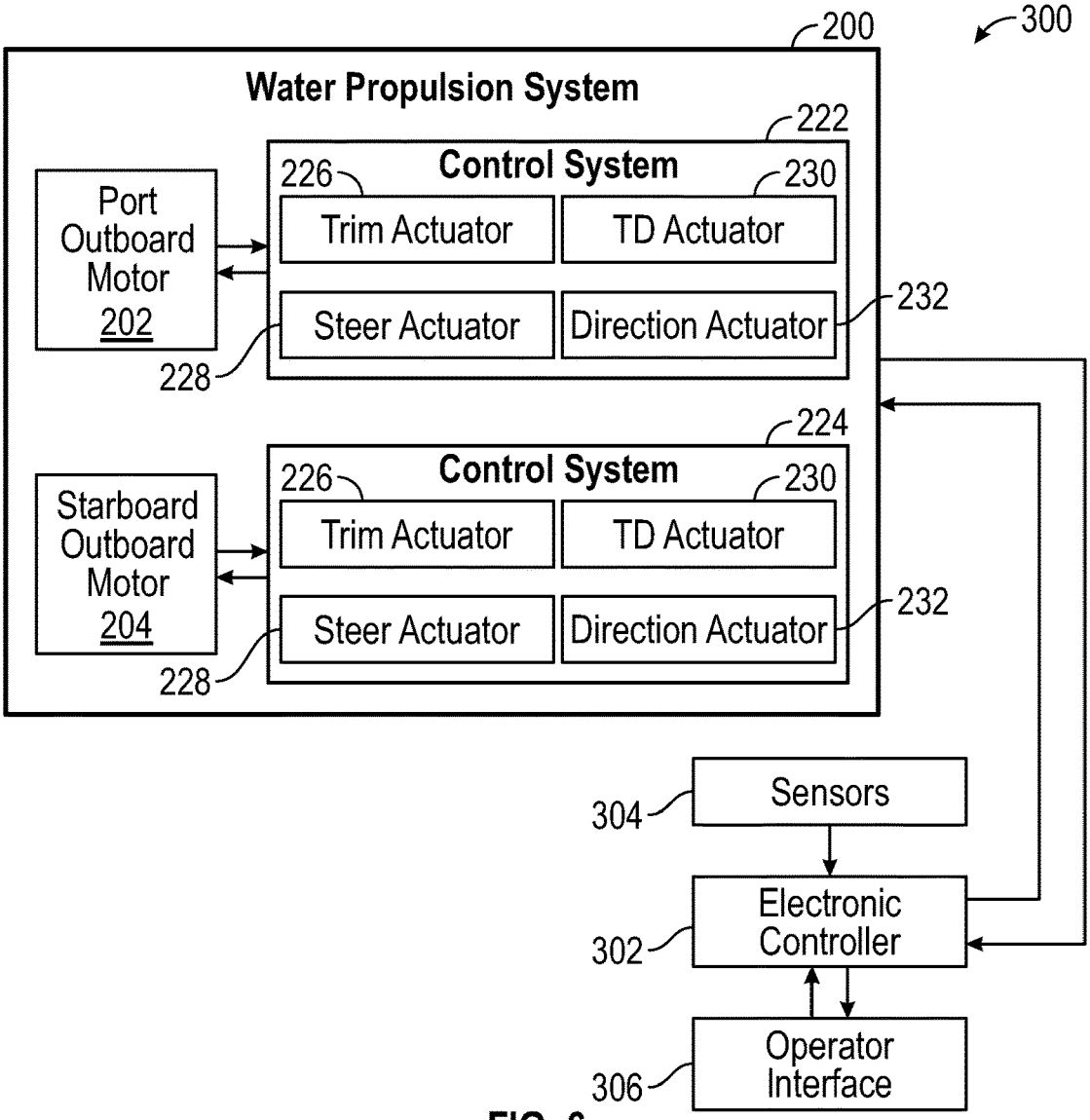
FIG. 6 illustrates further information regarding the control system of FIG. 5.

Referring to FIG. 6, each of port side outboard motor 202 and starboard side outboard motor 204 of propulsion system 200 includes a respective control system 222, 224. In embodiments, a single control system is provided for both port side outboard motor 202 and starboard side outboard motor 204. In embodiments, each of control systems 222, 224 includes an electronic controller (not shown) which communicates with electronic controller 302 over a wired and/or wireless network to receive instructions and provide feedback, such as an radio frequency network. In embodiments, each of control systems 222, 224 receive serial inputs from electronic controller 302 as instructions and provide feedback.

Figure 4:
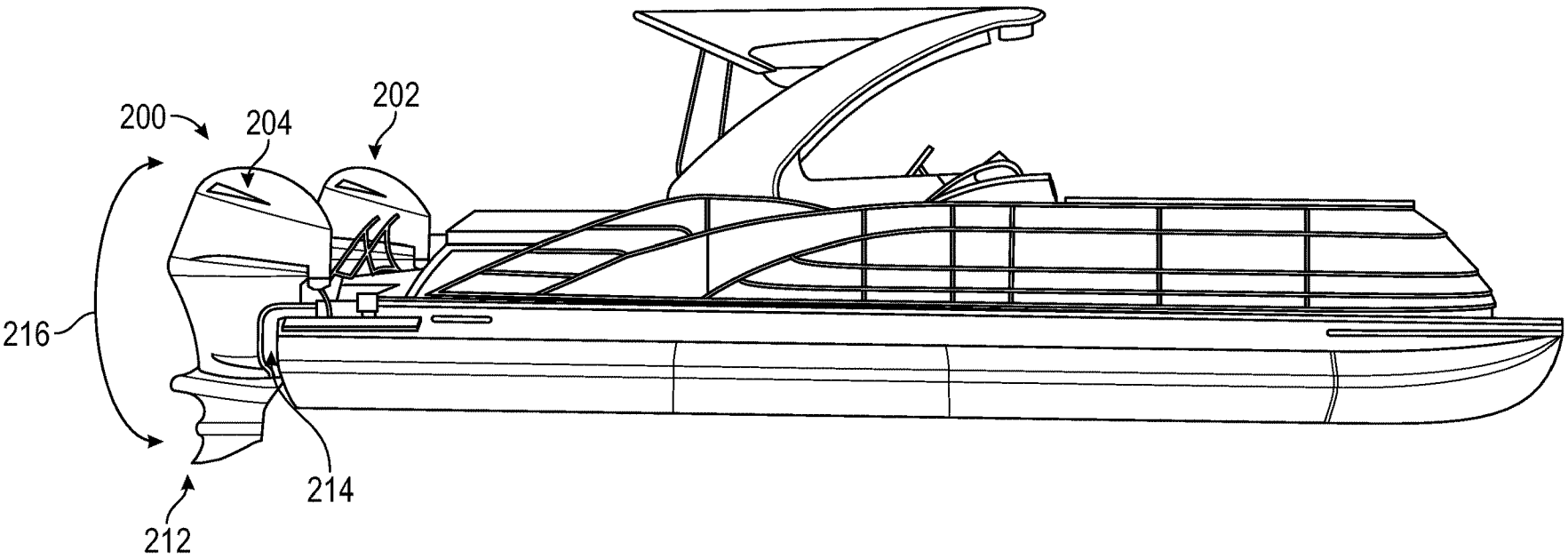
FIG. 4 illustrates a side view of the pontoon boat of FIG. 1.
Figure 7:
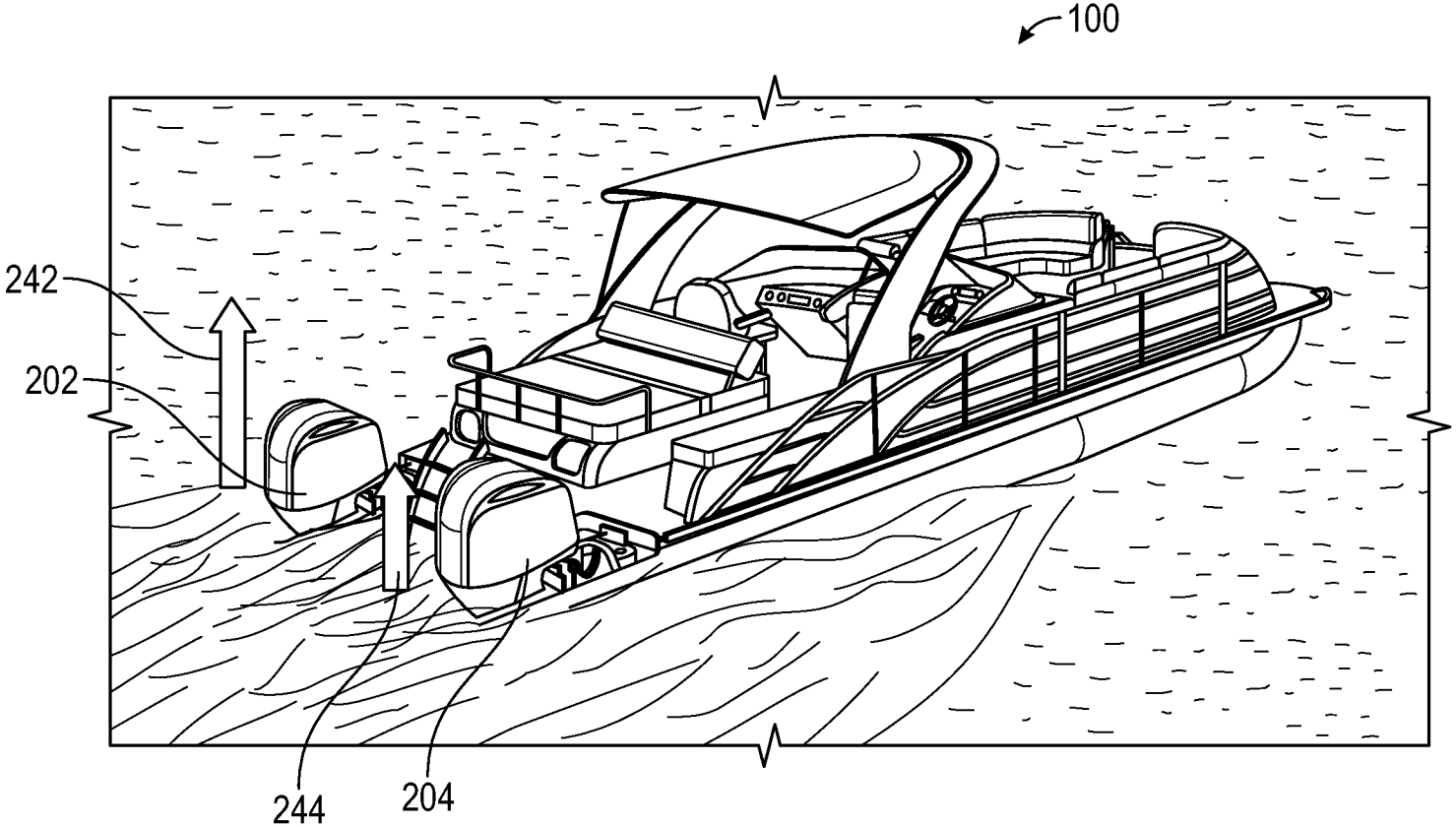
FIG. 7 illustrates the pontoon boat of FIG. 1 moving through the water.

Each of control systems 222, 224 includes a trim actuator 226 which alters an orientation of the respective port side outboard motor 202 and starboard side outboard motor 204 in direction 216 (see FIG. 4). A representation of a trim level for each of port side outboard motor 202 and starboard side outboard motor 204 is illustrated in FIG. 7 as arrows 242 and 244, respectively. The trim level of each of port side outboard motor 202 and starboard side outboard motor 204 may be individually controlled. Based on arrows 242 and 244, port side outboard motor 202 is raised higher than starboard side outboard motor 204. An exemplary trim actuator 226 includes one or more hydraulic or pneumatic cylinders and a mechanical linkage.

Figure 8:
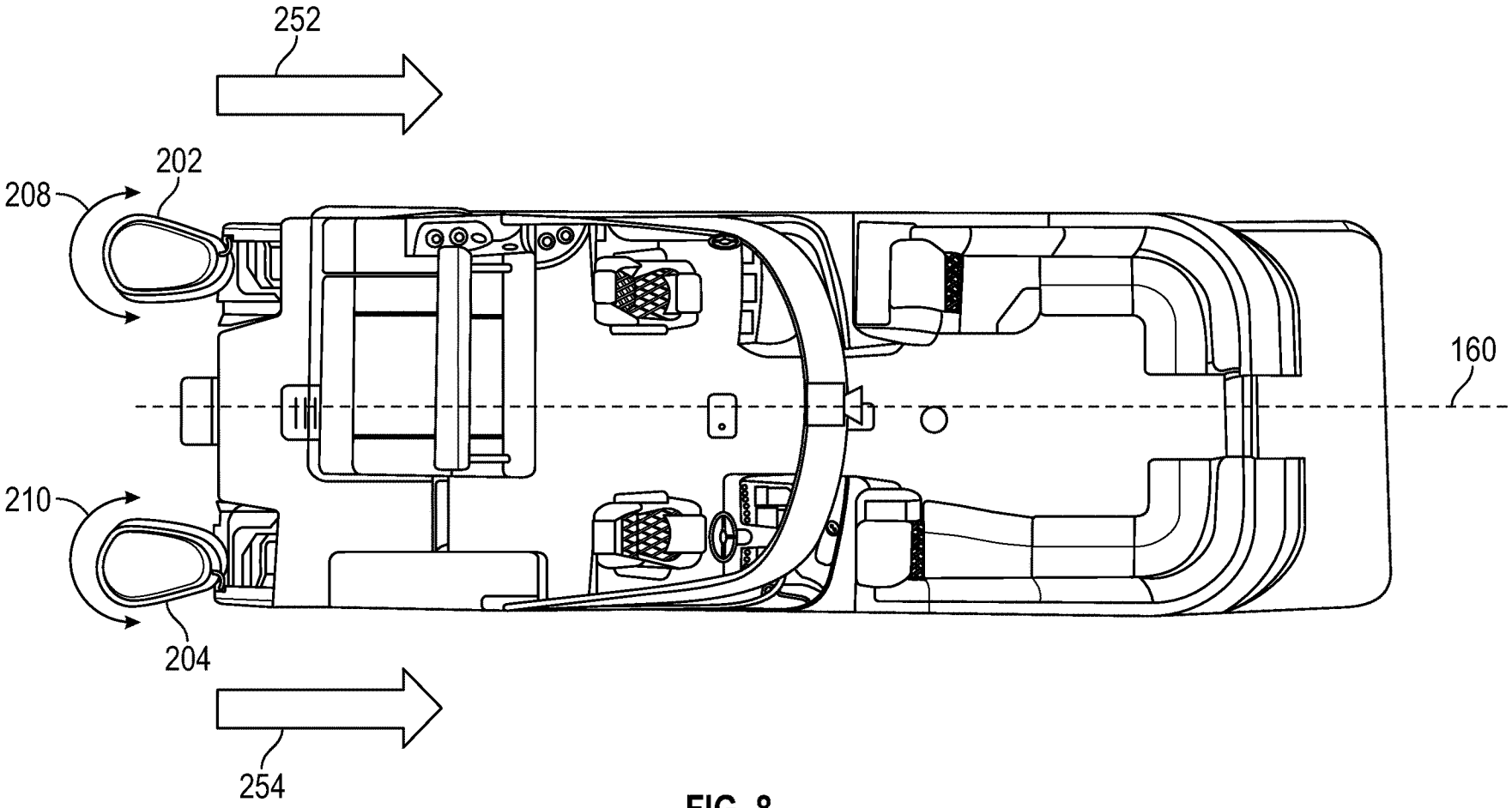
FIG. 8 illustrates a top view of the pontoon boat of FIG. 1.

Each of control systems 222, 224 includes a steer actuator 228 which alters an orientation of the respective port side outboard motor 202 and starboard side outboard motor 204 in the respective directions 208, 210 (see FIG. 8). As illustrated in FIG. 8, each of port side outboard motor 202 and starboard side outboard motor 204 are oriented parallel to longitudinal centerline 160 of pontoon boat 100. The steer angle from parallel to longitudinal centerline 160 of each of port side outboard motor 202 and starboard side outboard motor 204 may be individually controlled. An exemplary steer actuator 228 includes one or more hydraulic or pneumatic cylinders and a mechanical linkage.

Each of control systems 222, 224 includes a thrust demand (TD) actuator 230 which alters a rotational speed of propeller 212 of the respective port side outboard motor 202 and starboard side outboard motor 204 and direction actuator 232 which sets a rotational direction of propeller 212 of the respective port side outboard motor 202 and starboard side outboard motor 204. A representation of the thrust demand level and direction for each of port side outboard motor 202 and starboard side outboard motor 204 is illustrated in FIG. 8 as arrows 252 and 254, respectively. Based on arrows 252 and 254, port side outboard motor 202 has a higher thrust demand setting than starboard side outboard motor 204 and the propellers of both port side outboard motor 202 and starboard side outboard motor 204 are rotating in the same direction to cause a forward thrust. Further, a change in thrust level may be an increase or positive thrust change (request to sped up pontoon boat 100) or a decrease or negative thrust change (request to slow pontoon boat 100). An exemplary thrust demand actuator controls one or more of a level of fuel and air provided to the engine for combustion. An exemplary direction actuator includes a gear set which operatively couples propeller 212 to the engine to rotate in either a first direction or a second direction.

Figure 9:
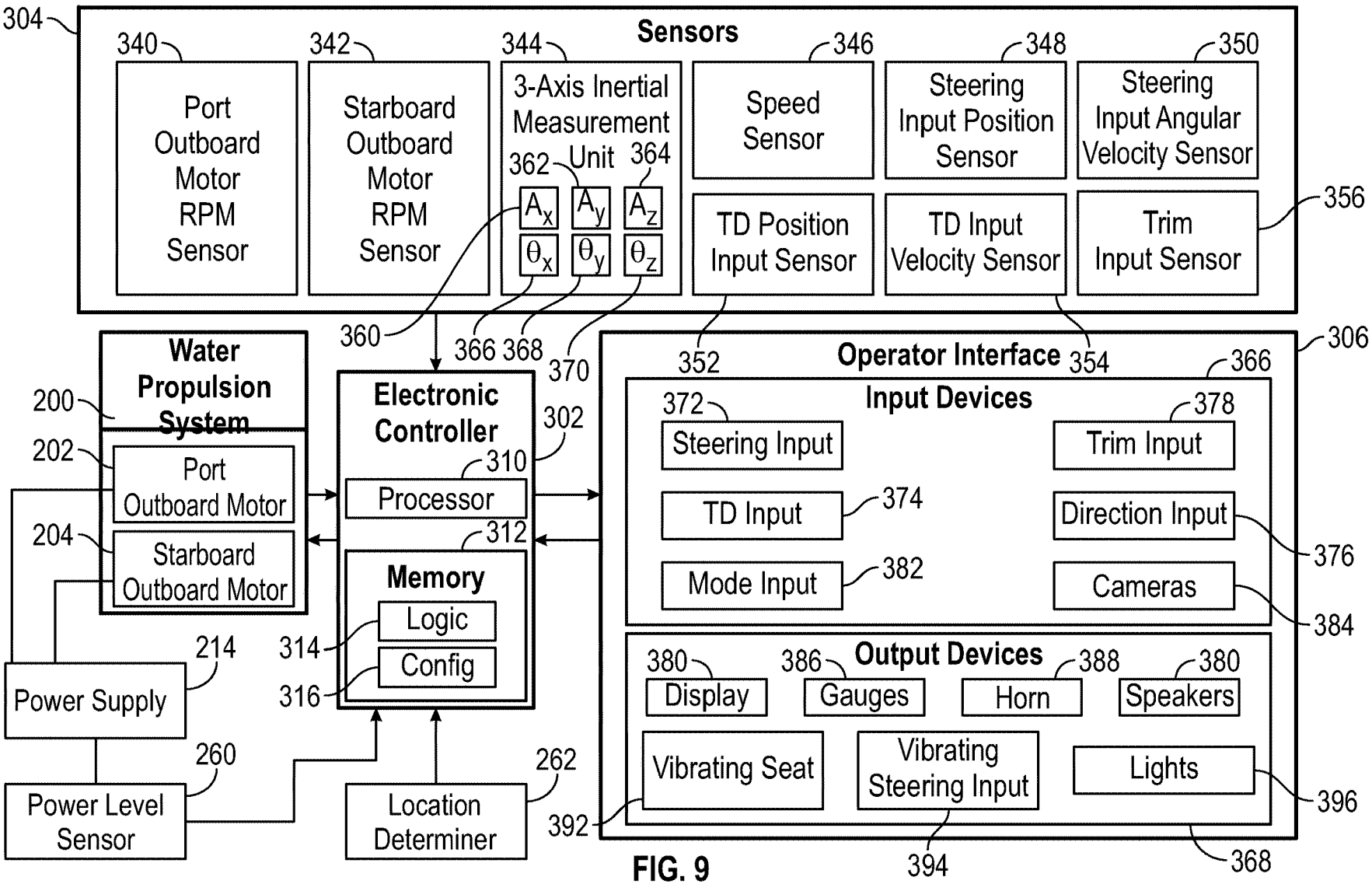
FIG. 9 illustrates further information regarding the control system of FIG. 5.

Referring to FIG. 9, an exemplary representation of control system 300 is shown. Electronic controller 302 includes at least one processor 310 and at least one non-transitory computer readable medium, memory 312. In embodiments, electronic controller 302 is a single unit that controls the operation of various systems of pontoon boat 100. In embodiments, electronic controller 302 is a distributed system comprised of multiple controllers each of which control one or more systems of pontoon boat 100 and may communicate with each other over one or more wired and/or wireless networks.

Electronic controller 302 includes maneuvering logic 314 which controls the operation of propulsion system 200 to control a direction of travel of pontoon boat 100 in water 10, a speed of pontoon boat 100 in water 10, and/or an angular pose of pontoon boat 100 in water 10. Further, memory 312 includes one or more configuration settings 316 for electronic controller 302. The configuration settings 316 may be used by maneuvering logic 314 in the control of propulsion system 200. Exemplary configuration settings include a horsepower, model, and weight of port side outboard motor 202 and starboard side outboard motor 204; a propeller diameter and pitch for the propellers 212 of port side outboard motor 202 and starboard side outboard motor 204; a width from starboard to port of pontoon boat 100; a length from bow to stern of pontoon boat 100; a number of the plurality of pontoons 106 and structure configuration; a maximum steer angle; a maximum trim height; a maximum steering actuation rate; a maximum trim actuation rate; a maximum roll angle in direction 152 about longitudinal axis 142; a maximum pitch angle in direction 154 about axis 152; a base trim level as a function of boat speed; a maximum steer angle as a function of boat speed; and a center of gravity (CG) location for pontoon boat 100.

The term "logic" as used herein includes software and/or firmware executing on one or more programmable processors, application-specific integrated circuits, field-programmable gate arrays, digital signal processors, hardwired logic, or combinations thereof. Therefore, in accordance with the embodiments, various logic may be implemented in any appropriate fashion and would remain in accordance with the embodiments herein disclosed. The non-transitory machine-readable medium comprising logic can additionally be considered to be embodied within any tangible form of a computer-readable carrier, such as solid-state memory, magnetic disk, and optical disk containing an appropriate set of computer instructions and data structures that would cause a processor to carry out the techniques described herein. This disclosure contemplates other embodiments in which electronic controller 302 is not microprocessor-based, but rather is configured to control operation of propulsion system 200 based on one or more sets of hardwired instructions.

Returning to FIG. 9, sensors 304 includes an revolutions per minute (rpm) sensor 340 for port side outboard motor 202, an rpm sensor 342 for starboard side outboard motor 204, an inertial measurement unit (IMU) 344, a speed sensor 346, a steering input position sensor 348, a steering input angular velocity sensor 350, a thrust demand position input sensor 352, a thrust demand input velocity sensor 354, and a trim input sensor 356. In embodiments, port motor rpm sensor is apart of control system 222 of port side outboard motor 202 and starboard rpm sensor 342 is apart of control system 224 of starboard side outboard motor 204.

IMU 334 includes a three-axis accelerometer and a three-axis gyroscope. Referring to FIGS. 1 and 9, the three-axis accelerometer provides linear acceleration data of pontoon boat 100 along axes 142 (see FIG. 9 $A_x$ 360), 144 (see FIG. 9 $A_y$ 362), and 146 (see FIG. 9 $A_z$ 364) and the three-axis gyroscope provides angular acceleration data of pontoon boat 100 about axes 142 (see FIG. 9 $\Theta_x$ 360), 144 (see FIGS. 9 $\Theta_y$ 362), and 146 (see FIG. 9 $\Theta_z$ 364). Additionally, IMU 334 provides a Euler angle value that represents the IMU's absolute orientation relative to the Earth's gravity vector.

In embodiments, IMU 344 is supported by deck 104 or plurality of pontoons 106 to provide an indication of acceleration forces of pontoon boat 100 during operation. Acceleration can be either positive (increasing) or negative (decreasing) in a given direction. In embodiments, IMU 344 is located along longitudinal centerline 160 of pontoon boat 100. In embodiments, IMU 344 is located at the unloaded center of gravity of pontoon boat 100. In embodiments, IMU 344 is offset from the center of gravity of pontoon boat 100 and the readings of IMU 344 are used by electronic controller 302 to determine the acceleration values of pontoon boat 100 at the center of gravity of pontoon boat 100. In one embodiment, IMU 344 is integrated into electronic controller 302. In one embodiment, IMU 344 is spaced apart from electronic controller 302. In embodiments, IMU 344 is isolated from deck 104 and/or plurality of pontoons 106 with isolation mounts, such as rubber mounts, to reduce the amount of engine vibration experienced by the IMU 344.

Speed sensor 346 provides an indication of a speed of pontoon boat 100 in the water 10. Exemplary speed sensors include paddlewheel sensors, pitot style pressure sensors, and other exemplary sensors. In embodiments, a GPS device is included and provides a speed of pontoon boat 100 based on position data over time.

Figure 10:
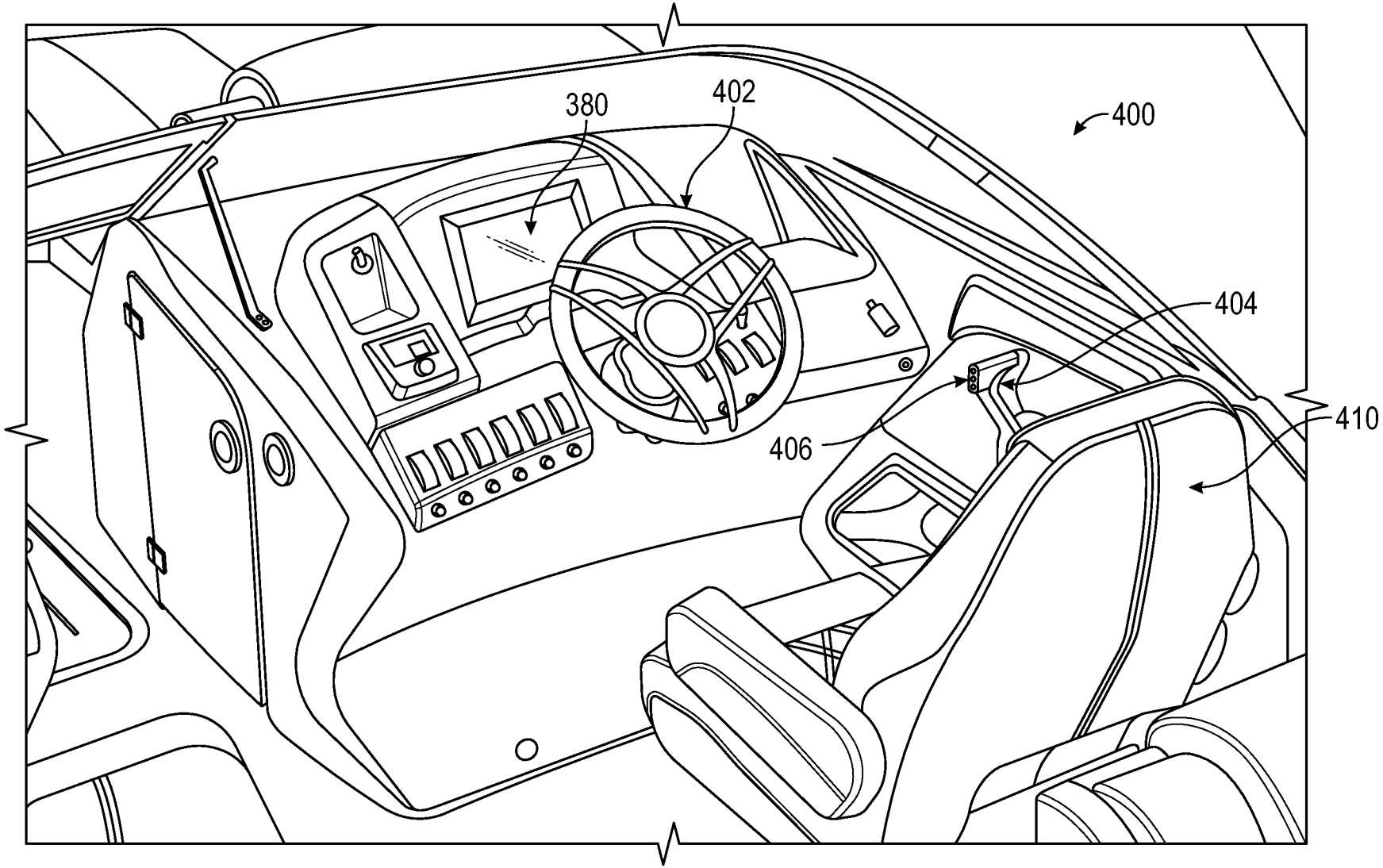
FIG. 10 illustrates an operator area of the pontoon boat of FIG. 1.

Steering input position sensor 348 monitors a position of a steering input 372 of the operator. Exemplary steering inputs include steering wheels, joysticks, and other devices for providing an input. Referring to FIG. 10, an exemplary operator area 400 for pontoon boat 100 is shown. Within operator area 400 is a steering wheel 402 as an exemplary steering input 372. An exemplary steering input position sensors include encoders, analog inputs, optical sensor, and other exemplary sensors.

Steering input angular velocity sensor 350 monitors a speed at which the operator is actuating the steering input 372 from a current steering position to a desired steering position (a slow turn with a large desired turning radius vs. a sharp turn with a tight desired turning radius). An exemplary steering input angular velocity sensor is an encoder. In one example the same encoder serves as both steering input position sensor 348 and steering input angular velocity sensor 350. In embodiments, a steering angle velocity is determined by time-differentiation of the determined steering angular position value.

Thrust demand input position sensor 352 monitors a position of a thrust demand input 374 of sensors 304. Exemplary thrust demand inputs include hand levers, pedals, joysticks, and other devices for providing an input. Referring to FIG. 10, a hand lever 404 is provide in operator area 400 as an exemplary thrust demand input 374. An exemplary thrust demand position input sensor include encoders, analog inputs, optical sensor, and other exemplary sensors.

Thrust demand input angular velocity sensor 354 monitors a speed at which the operator is actuating the thrust demand input 374 from a current thrust demand position to a desired thrust demand position (a quick desired acceleration vs. a slow desired acceleration). An exemplary thrust demand input velocity sensor 354 is an encoder. In one example the same encoder serves as both thrust demand input position sensor 352 and thrust demand input angular velocity sensor 354. In embodiments, a thrust demand input angular velocity is determined by time-differentiation of the determined thrust demand input position value.

Thrust demand position sensor 352, in embodiments, also serves as a direction input sensor to monitor requested thrust direction for propulsion system 200. Referring to FIG. 10, hand lever 404 provided in operator area 400 also serves as an exemplary direction input 376. When hand lever 404 is in a first position, propulsion system 200 is configured in a neutral configuration (no turning of the propellers). Actuating hand lever 404 forward towards the bow of pontoon boat 100 from the neutral position indicates a desired forward movement of pontoon boat 100 or an assisted deceleration of pontoon boat 100 when pontoon boat 100 is moving in the rearward direction. Actuating hand lever 404 rearward towards the stern of pontoon boat 100 from the neutral position indicates a desired rearward movement of pontoon boat 100 or an assisted deceleration of pontoon boat 100 when pontoon boat 100 is moving in the forward direction. In embodiments, a separate direction input is provided and a separate sensor to monitor the direction input.

Trim input sensor 356 monitors a position of a trim input 378 of sensors 304. Exemplary trim inputs include hand levers, switches, pedals, displays, joysticks, and other devices for providing an input. Referring to FIG. 10, hand lever 404 provided in operator area 400 includes a plurality of switches as an exemplary trim input 378. An exemplary trim input sensor 356 monitors a state of the plurality of switches 406. Additional exemplary trim sensors include analog sensors, contact potentiometric sensors, hall effect sensors, and other suitable sensors.

Referring to FIG. 9, operator interface 306 includes a plurality of input devices 366 and a plurality of output devices 368. Several exemplary input devices 366 have been described. Additional exemplary input devices 366 include levers, buttons, switches, soft keys, touch screens, and other suitable input devices. Exemplary output devices 368 include lights, displays, audio devices, tactile devices, and other suitable output devices. In embodiments, operator interface 306 includes a display 380, such as a touch screen display, and electronic controller 302 interprets various types of touches to the touch screen display as inputs and controls the content displayed on touch screen display.

In embodiments, input devices 366 includes a mode input 382. Mode input 382 provides an indication to electronic controller 302 of limits, setups, and other characteristics for propulsion system 200 of pontoon boat 100. The mode input is also intended to provide noticeable differentiation in maneuverability characteristics of the boat. Exemplary modes include cruise mode, sport mode, novice mode and other suitable modes. Cruise mode includes settings to assist in keeping pontoon boat 100 level. Sport mode includes settings to permit more aggressive turning and/or acceleration than the cruise mode. Novice mode includes settings to limit a speed and turning performance characteristic of pontoon boat 100. Exemplary turning performance characteristics include a maximum allowed lateral acceleration of pontoon boat 100. For novice mode a lower maximum lateral acceleration is specified compared to cruise mode and sport mode, thereby limiting the turning aggressiveness of the pontoon boat 100. Further, for cruise mode, the maximum lateral acceleration may be set at a level to limit aggressive turning to reduce sudden movements of the pontoon boat to increase passenger enjoyment of an intended cruising of the pontoon boat 100.

In embodiments, input devices 366 further includes one or more cameras 384. In one example, the output of the one or more cameras is displayed on display 380 of output devices 368. Referring to FIG. 3, in one example, pontoon boat 100 includes a 360 degree view camera 384A positioned on top of a canopy support 190. Alternatively or additionally, pontoon boat 100 may include a port side camera 384B, a starboard side camera 384C, a bow camera 384D, and a stern camera 384E. In embodiments, electronic controller 302 selects the output of one of camera 384A (if provided) or port side camera 384B (if provided) when pontoon boat 100 is turning to port and displays the output on display 380 in operator area 400 (see FIG. 10) and selects the output of one of camera 384A (if provided) or starboard side camera 384C (if provided) when pontoon boat 100 is turning to starboard and displays the output on display 380 in operator area 400 (see FIG. 10).

Additional exemplary output devices 368 include gauges 386, a horn 388, one or more speakers 390, a vibrating operator seat 410 (see FIG. 10), a vibrating steering input 394, such as steering wheel 402, and one or more lights 396. Output devices may be used to provide warnings to the operator of pontoon boat 100.

Figure 11:
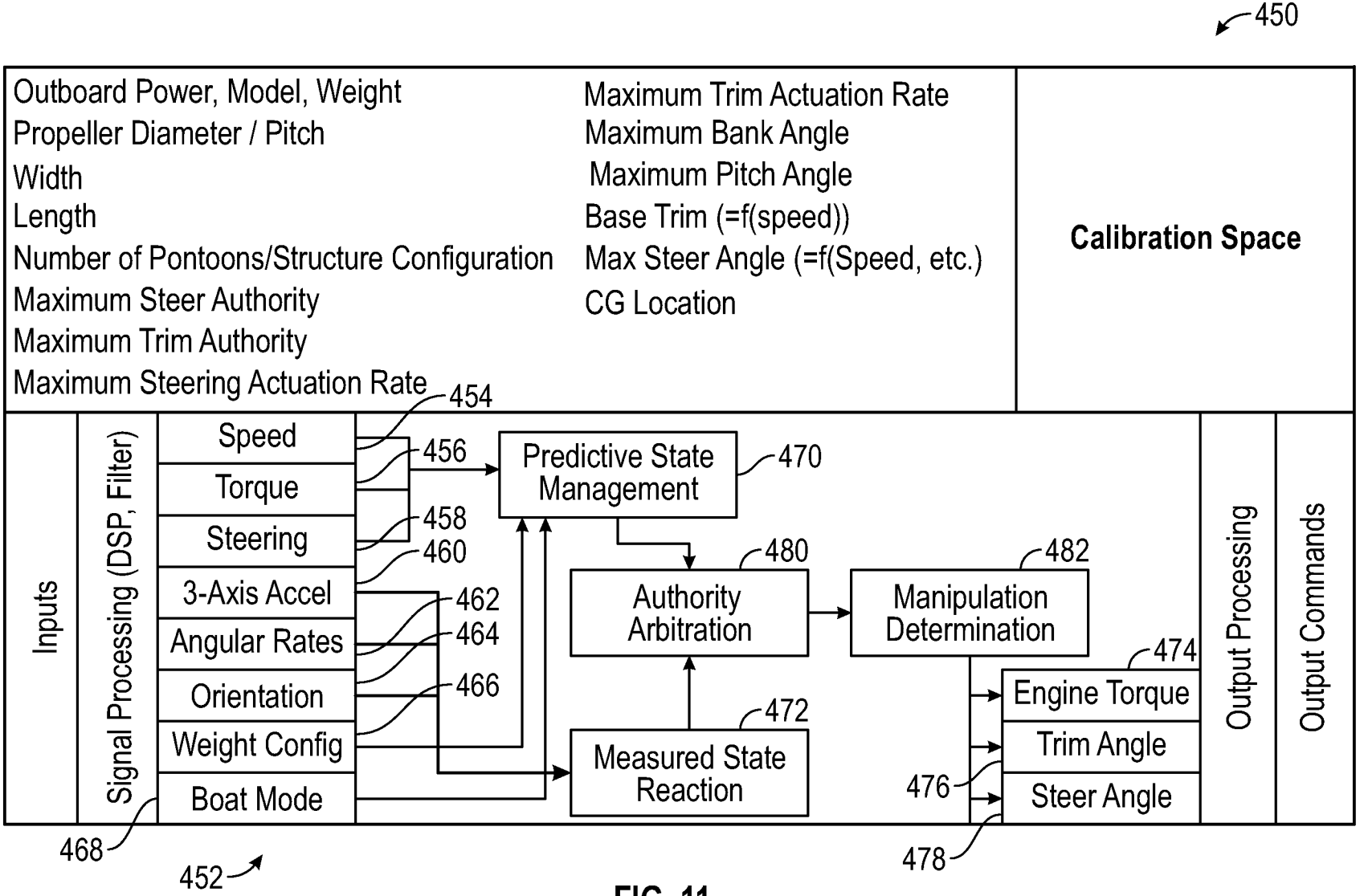
FIG. 11 illustrates an exemplary processing sequence of the control system of the pontoon boat of FIG. 1.

Referring to FIG. 11, an exemplary processing sequence of maneuvering logic 314 executed by processor 310 is shown. A plurality of inputs 452 are received by processor 310. The inputs include boat speed 454, an engine torque 456 for each of port side outboard motor 202 and starboard side outboard motor 204, steering inputs 458 (such as steering input position and velocity), linear accelerations 460 from IMU 344, angular accelerations 462 from IMU 344, an orientation 464 of pontoon boat 100, a weight distribution 466 of pontoon boat 100, and a current boat mode 468 selected with mode input 382. In embodiments, the orientation of pontoon boat 100 is a resolved Euler Angle of the center of gravity of pontoon boat 100 relative to gravity. It is a roll, pitch, and heading angle calculated via the measurement of linear acceleration, angular rates, and a speed reference value. In embodiments, the weight distribution 466 of pontoon boat 100 is manually specified by the operator through operator interface 306. The operator may specify the number of passengers on pontoon boat 100, the number of passengers on a forward half of pontoon boat 100, and/or the number of passengers on a rear half of pontoon boat 100 to provide a weight distribution characteristic. In embodiments, one or more sensors are included on pontoon boat 100 to sense a position of passengers and/or a weight on various seats of pontoon boat 100. Exemplary sensors include, weight sensors, cameras, pressure sensors, and other suitable sensors. In embodiments, a weight distribution characteristic is learned by the electronic controller 302 based on readings from IMU 344. Boat speed 454, engine torque 456, steering inputs 458, weight configuration 466, and current boat mode 468 are input to a predictive state management block, as represented by block 470. The predictive state management block is the vehicle dynamics that result from the current state of propulsion of pontoon boat 100 if manipulation through operator interface 306 is executed and provides a recommendation regarding one or more of an engine torque 474 for one or both of port side outboard motor 202 and starboard side outboard motor 204, a trim level 476 for one or both of port side outboard motor 202 and starboard side outboard motor 204, and a steer angle 478 for pontoon boat 100 (by controlling the angle of port side outboard motor 202 and/or starboard side outboard motor 204 in directions 208 and 210, respectively, and/or the engine torques one or both of port side outboard motor 202 and starboard side outboard motor 204). Linear accelerations 460, angular accelerations 462, and orientation 464 are input into a measured state reaction block, as represented by block 472. The measured state reaction block responds to a measured state of pontoon boat 100 and provides a recommendation regarding one or more of an engine torque 474 for one or both of port side outboard motor 202 and starboard side outboard motor 204, a trim level 476 for one or both of port side outboard motor 202 and starboard side outboard motor 204, and a steer angle 478 for pontoon boat 100 (by controlling the angle of port side outboard motor 202 and/or starboard side outboard motor 204 in directions 208 and 210, respectively, and/or the engine torques one or both of port side outboard motor 202 and starboard side outboard motor 204). Examples of measured states of pontoon boat 100 include turning, accelerating, banking, pitching, planing, and other states of pontoon boat 100. In an exemplary embodiment, planing is determined based on a pitch angle of pontoon boat 100 and a speed of pontoon boat 100. An exemplary recommendation, such as for a measured planing state, would be to have the trim down at lower speeds and raised up partway at cruising speed. In an exemplary embodiment, turning is determined based on one or more of a steering input position, a lateral acceleration of the pontoon boat, and/or other inputs. An exemplary recommendation, such as for a turning state, would be to raise the trim on the outboard motor 202, 204 on the inside of the turn and to lower the trim on the outboard motor 202, 204 on the outside of the turn, to cause pontoon boat 100 to lean into the turn.

The recommendations of predictive state management block 470 and measured state reaction block 472 are input to an authority arbitration block, represented by block 480. The authority arbitration block reviews the recommendations and resolves potential conflicting control requirements and make a determination what the actual manipulation will be for pontoon boat 100. For instance, if an operator cuts acceleration mid-turn, the arbitration block may rate decay or prohibit an instant throttle cut to continue to execute the turn in a stable manner. The final recommendations are provided to a manipulation determination block, as represented by block 482 and output to propulsion system 200.

In embodiments, the steering of pontoon boat 100 is handled electronically and steering input 372 is not mechanically operatively coupled to steer actuator 228 of port side outboard motor 202 or starboard side outboard motor 204. Electronic controller 302 may alter a steer ratio of steering input 372 based on a speed of pontoon boat 100 and, optionally additional inputs. In embodiments, steering input 372 is mechanically operatively coupled to steer actuator 228 of port side outboard motor 202 and starboard side outboard motor 204. electronic controller 302 may still alter a steer ratio of steering input 372 based on a speed of pontoon boat 100 and, optionally additional inputs. An exemplary system which allows for a variable steer ratio while maintaining a mechanical connection between steering input 372 and propulsion system 200 is the Active Front Steering (AFS) system available from Joyson Safety Systems located in Auburn Hills, Mich.

Figure 12:
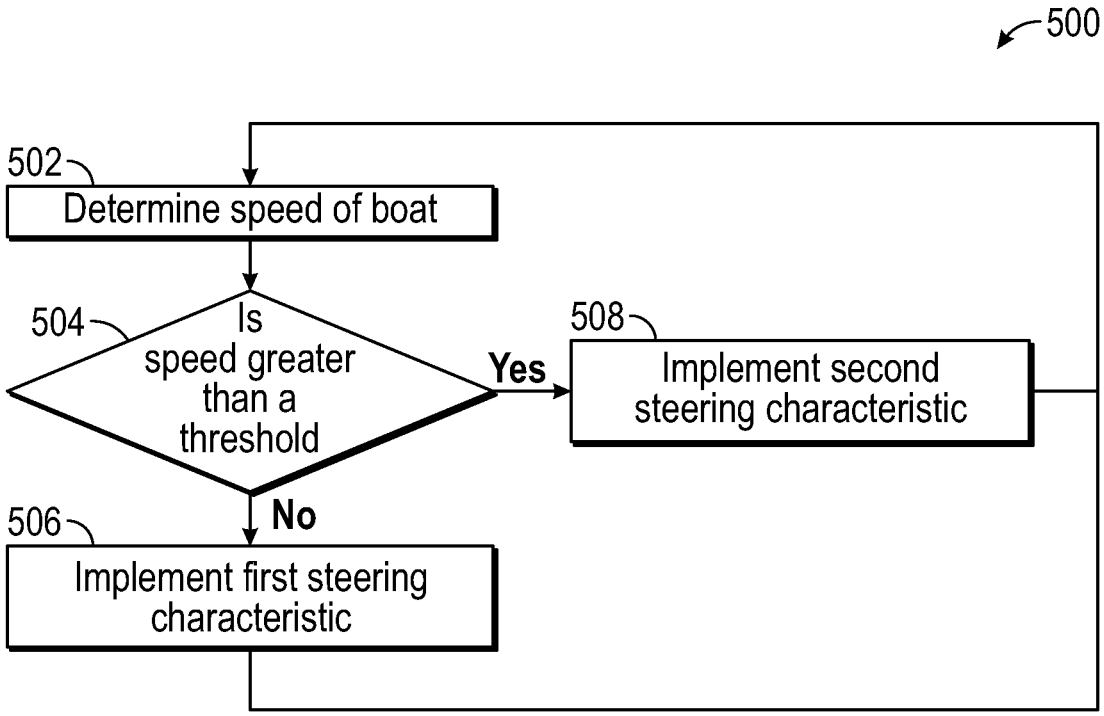
FIG. 12 illustrates another exemplary processing sequence of the control system of the pontoon boat of FIG. 1.

In embodiments, based on steering input position sensor 348 and speed sensor 346, electronic controller 302 determines a steering angle 478 to output to propulsion system 200. Referring to FIG. 12, an exemplary processing sequence 500 of maneuvering logic 314 executed by processor 310 is shown. Electronic controller determines a speed of pontoon boat 100, as represented by block 502. The determined speed is compared to a threshold value, as represented by block 504. If the speed is at or below the threshold value, then a first steering characteristic is implemented, as represented by block 506. If the speed is above the threshold value then a second steering characteristic is implemented, as represented by block 508. In one example, the first and second steering characteristics are steering ratios of a movement of the steering input 372 of the operator interface 306, such as steering wheel 402, to the resultant movement of the steering actuator 228 of at least one of port side outboard motor 202 and starboard side outboard motor 204. For example, up to 30 miles per hour or 40 miles per hour, a steering ratio of 1:1 is implemented and above 30 miles per hour or 40 miles per hour, a steering ratio of 1:0.8 is implemented. In embodiments, other inputs alter the threshold value. Exemplary inputs include lateral acceleration, boat mode, estimated center of gravity of pontoon boat, steering input angular velocity, and/or other suitable inputs.

Figure 13:
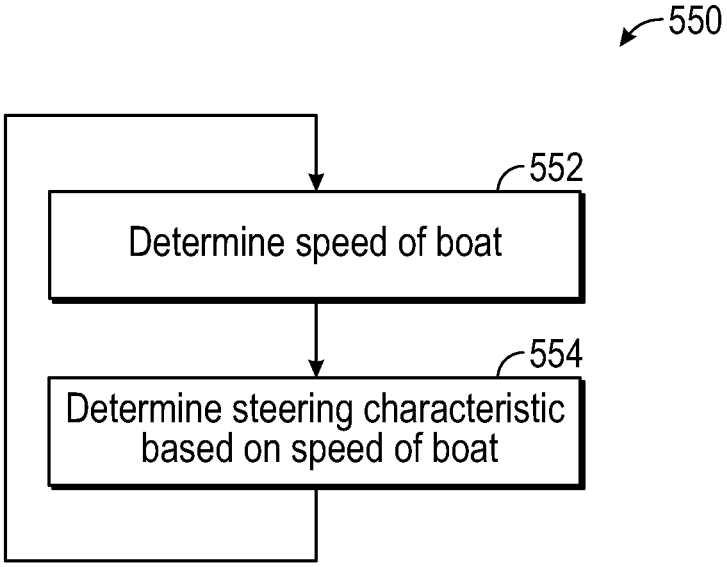
FIG. 13 illustrates a further exemplary processing sequence of the control system of the pontoon boat of FIG. 1.
Figure 14:
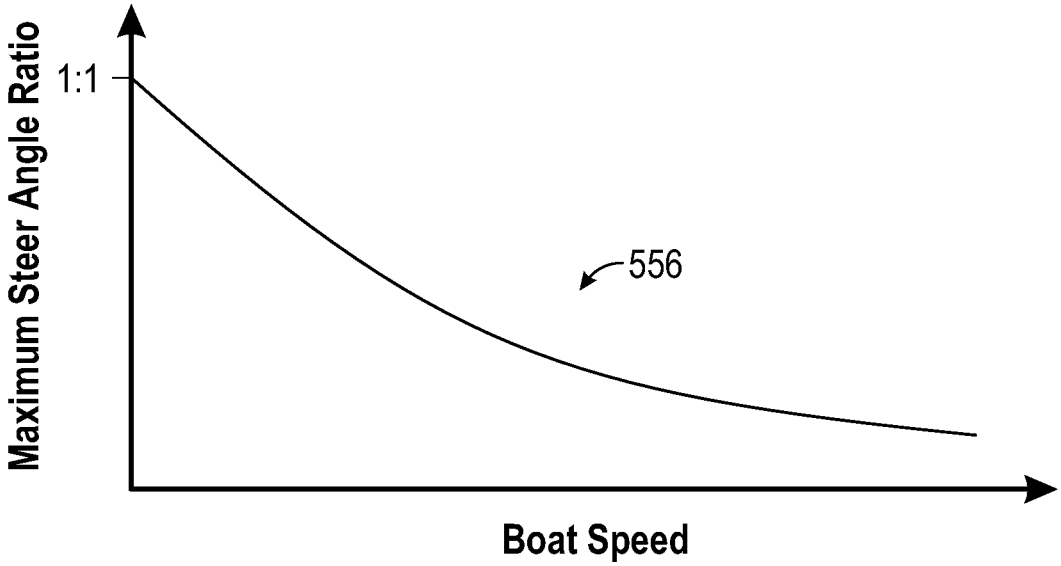
FIG. 14 illustrates an exemplary steer ratio curve of the control system of FIG. 5.

Referring to FIGS. 13 and 14, an exemplary processing sequence 550 of maneuvering logic 314 executed by processor 310 is shown. Electronic controller 302 determines a speed of pontoon boat 100, as represented by block 552. The determined speed is used to determine a steering characteristic, as represented by block 554. In one example, the steering characteristic is a steering ratio of a movement of the steering input 372 of the operator interface 306, such as steering wheel 402, to the resultant movement of the steering actuator 228 of at least one of port side outboard motor 202 and starboard side outboard motor 204. FIG. 12 illustrates curve 556 as a first exemplary maximum steer angle ratio as a function of pontoon boat speed. In one embodiment, electronic controller 302 is programmed with the function defining the curve 556 and determines the speed ratio by inputting the pontoon boat speed into the function. In another embodiment, electronic controller 302 has access to a lookup table with values approximating curve 556 and the speed ratio value is retrieved from the table based on the measured pontoon boat speed. In embodiments, other inputs alter the threshold value. Exemplary inputs include lateral acceleration, boat mode, estimated center of gravity of pontoon boat, steering input angular velocity, and/or other suitable inputs.

In embodiments, an operator of pontoon boat 100 may request through operator interface 306 a combination of steer angle and speed that is predicted to result in an unstable movement dynamic for the pontoon boat 100 or the pontoon boat 100 may be experiencing an unstable movement dynamic due to changes in the water characteristics, such as increased waves. In embodiments, electronic controller 302 provides feedback to the operator through operator interface 306 of the unstable movement dynamic for pontoon boat 100. Exemplary feedback includes one or more of a visual representation on display 380 of operator interface 306; a tactile feedback, such as a vibrating operator seat 410 or vibrating steering wheel 402; and an audio feedback, such as horn 388 and speakers 390. Further, in embodiments, electronic controller 302 alters the at least one of the adjustable torque output, the adjustable thrust direction, and the adjustable trim level of port side outboard motor 202 and/or starboard side outboard motor 204 to provide a stable movement dynamic for the pontoon boat 100.

Figure 15:
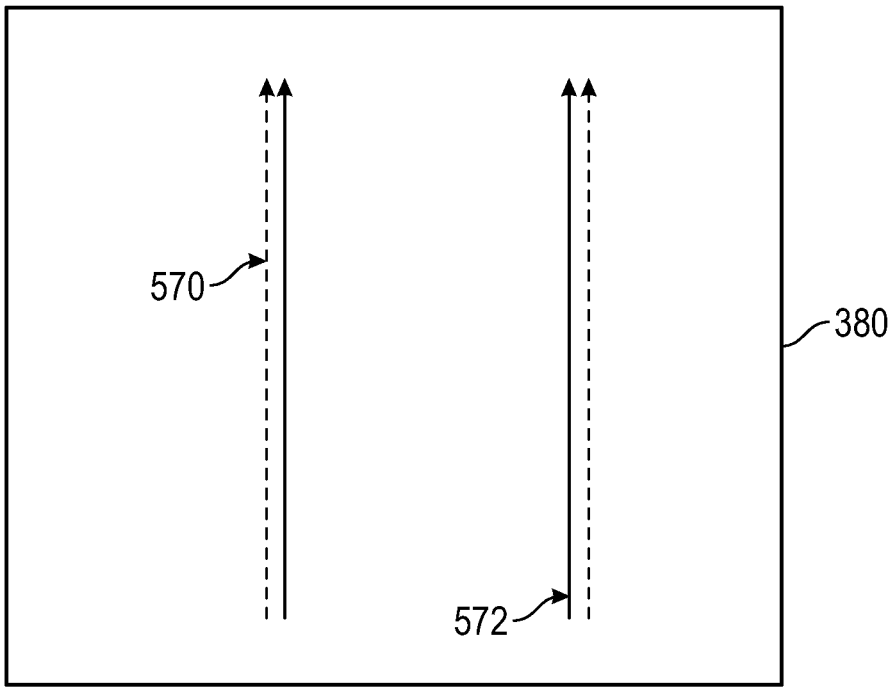
FIG. 15 illustrates a first exemplary visual feedback on the display of the operator interface.
Figure 16:
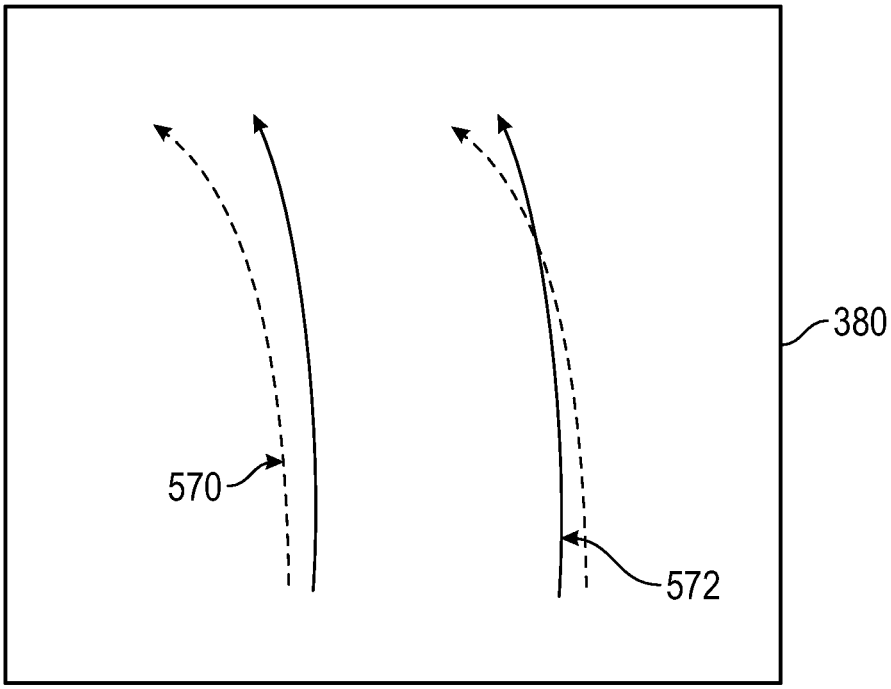
FIG. 16 illustrates a second exemplary visual feedback on the display of the operator interface.
Figure 17:
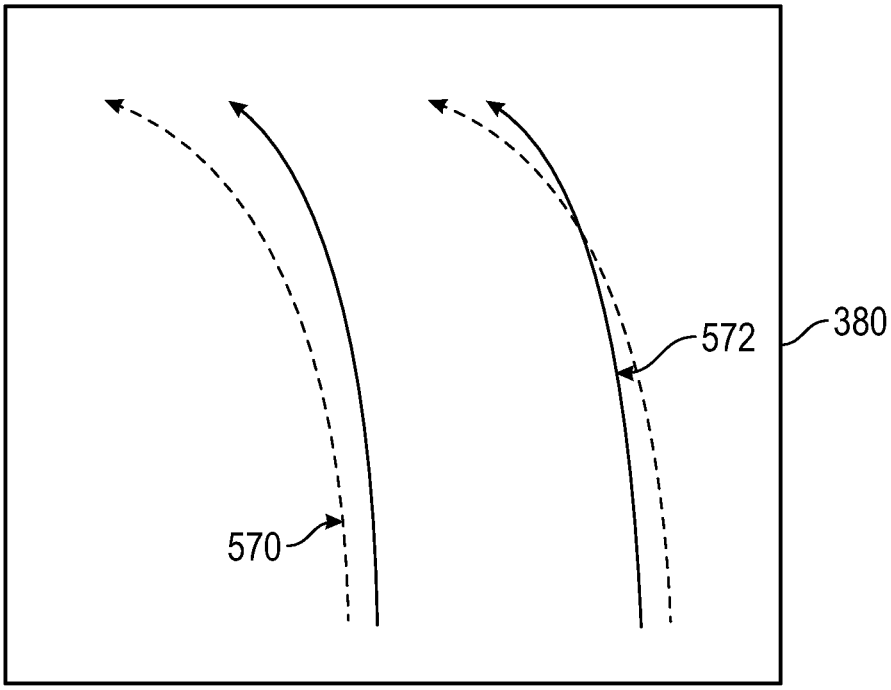
FIG. 17 illustrates a third exemplary visual feedback on the display of the operator interface.

Referring to FIGS. 15-17, exemplary visual feedback on display 380 are illustrated. Referring to FIG. 15, pontoon boat 100 is moving straight ahead. Dashed lines 570 indicate the current trajectory of pontoon boat 100 and the solid lines 572 indicate the requested boat steering input position. The green color of the solid lines indicates a stable movement dynamic for pontoon boat 100. Referring to FIG. 16, pontoon boat 100 is turning to port as indicated by dashed lines 570 and the requested boat steering input position, represented by the green solid lines, indicates a stable movement dynamic for pontoon boat 100. Referring to FIG. 17, pontoon boat 100 is making a sharper turn to port as indicated by dashed lines 570 and the requested boat steering input position, represented by the red solid lines, indicates an unstable movement dynamic for pontoon boat 100. The unstable movement dynamic may be due to high winds resulting in choppy waves.

In embodiments, electronic controller 302 monitors an operation of one or both of port outboard motor 202 and starboard outboard motor 204. For example, may monitor RPM sensors 340, 342 for motors 202, 204, respectively to determine if one of the motors is not running. In such a scenario, the non-running motor 202,204 may be positioned in a trim full up position by electronic controller 302 and electronic controller 302 will control the trim, steer angle, and thrust demand for the running motor 202, 204 to maintain boat 100 on a desired course. Electronic controller 302 is able to receive commands from input devices 366 for a desired course and then based on the location of the remaining running motor set one or more of the trim, the steer angle, and the thrust demand for that motor to achieve the desired course. In essence, allow a single engine to power movement of boat 100 in a similar manner as when both engines are operational. In embodiments, one or more output devices 368 provide an indication to the operator of the non-running state of one of motors 202, 204.

In other embodiments, electronic controller 302 monitors one or more sensors to determine if the propeller 212 of either port outboard motor 202 and starboard outboard motor 204 has been damaged. Exemplary sensors include vibration sensors, RPM sensors (monitor difference from intended RPM based on thrust demand and trim), and other suitable sensors. In such a scenario, the motor with the damaged propeller may be turned off and positioned in a trim full up position by electronic controller 302 and electronic controller 302 will control the trim, steer angle, and thrust demand for the running motor to maintain boat 100 on a desired course. Electronic controller 302 is able to receive commands from input devices 366 for a desired course and then based on the location of the remaining running motor set one or more of the trim, the steer angle, and the thrust demand for that motor to achieve the desired course. In essence, allow a single engine to power movement of boat 100 in a similar manner as when both engines are operational. In embodiments, one or more output devices 368 provide an indication to the operator of the non-running or damaged state of one of motors 202, 204.

Referring to FIG. 9, boat 100 further includes a power supply 214, such as a fuel tank and associated lines when motors 202, 204 are internal combustion motors or battery bank and associated inverters and wiring buses when motors 202, 204 are electric motors, which provides power to motors 202, 204. Further, a power level sensor 260 monitors a characteristic of power supply 214, such as a fuel level for a fuel tank or a state-of-charge for a battery bank, and provides an indication to electronic controller 302. Electronic controller based on the level of the of the power supply may turn-off and place one of motors 202, 204 in a full trim up position and to conserve further depletion of power source 214 and thus permit additional range for boat 100 compared to powering both of motors 202, 204. Electronic controller 302 is able to receive commands from input devices 366 for a desired course and then based on the location of the remaining running motor set one or more of the trim, the steer angle, and the thrust demand for that motor to achieve the desired course. In embodiments, electronic controller conserves power usage in response to a request through one or more input devices 366. In embodiments, boat 100 includes a location determiner, such as a GPS system, and electronic controller 302 automatically calculates an estimated power usage for boat 100 based on a current position of boat 100 determined by location determiner 262 relative to one or more power supply locations, such as a refueling station or a charging station, stored in memory 312. Based on the estimated power usage and the detected characteristic of the power supply, electronic controller 302 conserve power by deactivating at least one motor. In embodiments, electronic controller 302 determines an estimated range of travel of boat 100 with both motors powered and compares the estimated distance to the power supply location and conserves power by deactivating at least one motor when the estimated range of travel is less than the estimated distance to the power supply location or when the difference between the estimated range of travel and the estimated distance is within a threshold amount.

While embodiments of the present disclosure have been described as having exemplary designs, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this invention pertains.

The invention claimed is:

1. A pontoon boat for navigation on water, comprising a plurality of water support members including at least a first water support member and a second water support member spaced apart from the first water support member;

a frame supported by the plurality of water support members;

a water propulsion system coupled to the frame to propel the boat through the water, the water propulsion system including a plurality of moveable motors, each of the plurality of moveable motors has an adjustable torque output and an adjustable thrust direction;

an operator interface including an operator steering input, a thrust demand input;

at least one sensor supported by the plurality water support members to monitor a movement characteristic of the pontoon boat through the water; and an electronic controller operatively coupled to the at least one sensor, the operator interface, and the water propulsion system, the electronic controller altering at least one of the adjustable torque and the adjustable thrust direction of at least one of the plurality of moveable motors based on a relationship between:

at least one of the operator steering input and the thrust demand input; and the movement characteristic monitored by the at least one sensor.

2. The pontoon boat of claim 1, each of the plurality of moveable motors further has an adjustable trim level and the electronic controller further altering the adjustable trim level based on at least one of a trim input of the operator interface, the operator steering input and the thrust demand input, and the movement characteristic monitored by the at least one sensor, and an adjustable trim level.

3. The pontoon boat of claim 1, wherein the electronic controller alters the at least one of the adjustable torque output and the adjustable thrust direction of at least one of the plurality of moveable motors based on a predicted movement of the pontoon boat.

4. The pontoon boat of claim 1, wherein the movement characteristic is an acceleration characteristic of the pontoon boat.

5. The pontoon boat of claim 4, wherein the acceleration characteristic is an angular acceleration characteristic.

6. The pontoon boat of claim 4, wherein the acceleration characteristic is a linear acceleration characteristic.

7. The pontoon boat of claim 1, wherein the movement characteristic is a longitudinal speed of the pontoon boat and the electronic controller adjusts a steering ratio of a movement of the steering input of the operator interface to the resultant movement of a steering actuator of at least one of the plurality of moveable motors of the water propulsion system based on the longitudinal speed of the pontoon boat.

8. The pontoon boat of claim 7, wherein the electronic controller alters a torque output of at least one of the plurality of moveable engines based on a first steering value from the steering input.

9. The pontoon boat of claim 8, wherein the plurality of movable motors includes a port outboard motor positioned at a stem of the pontoon boat and a starboard outboard motor positioned at the stem of the pontoon boat and the electronic controller lowers a torque output of the port outboard motor when the first steering value from the steering input indicates a tum to port.

10. The pontoon boat of claim 8, further comprising at least one camera and the operator interface includes a display and the electronic controller in response to the first steering value from the steering input indicating the turn to port displays an output from the at least one camera showing a view including the water from a port side of the pontoon boat on the display.

11. The pontoon boat of claim 1, wherein the movement characteristic is a lateral acceleration of the pontoon boat and the electronic controller adjusts a steering ratio of a movement of the steering input of the operator interface to the resultant movement of a steering actuator of at least one of the plurality of moveable motors of the water propulsion system based on the lateral acceleration of the pontoon boat.

12. The pontoon boat of claim 1, wherein the movement characteristic is a magnitude of a roll angle about a longitudinal axis of the pontoon boat.

13. The pontoon boat of claim 1, wherein the movement characteristic is a magnitude of a pitch angle about a lateral axis of the pontoon boat.

14. The pontoon boat of claim 1, wherein in response to at least one input from the operator interface resulting in an unstable movement dynamic for the pontoon boat, the electronic controller provides feedback to the operator through the operator interface.

15. The pontoon boat of claim 14, wherein the feedback includes a visual representation on a display of the operator interface.

16. The pontoon boat of claim 14, wherein the feedback includes a tactile feedback.

17. The pontoon boat of claim 14, wherein the feedback includes an audio feedback.

18. The pontoon boat of claim 14, wherein the electronic controller alters the at least one of the adjustable torque output, the adjustable thrust direction, and an adjustable trim level of at least one of the plurality of moveable motors to provide a stable movement dynamic for the pontoon boat.

19. The pontoon boat of claim 1, wherein the operator interface further includes a mode input and the electronic controller alters the at least one of the adjustable torque output, the adjustable thrust direction, and the adjustable trim level of at least one of the plurality of moveable motors based on a selected operation mode of the pontoon boat.

20. The pontoon boat of claim 1, wherein the electronic controller determines an estimated center of gravity of the pontoon boat and alters the at least one of the adjustable torque output, the adjustable thrust direction, and an adjustable trim level of at least one of the plurality of moveable motors based on the estimated center of gravity of the pontoon boat.

21. The pontoon boat of claim 1, wherein the operator interface includes at least one input to receive a weight distribution characteristic of the pontoon boat and the electronic controller alters the at least one of the adjustable torque output, the adjustable thrust direction, and an adjustable trim level of at least one of the plurality of moveable motors based on the weight distribution characteristic.

22. The pontoon boat of claim 1, wherein the electronic controller alters the at least one of the adjustable torque output, the adjustable thrust direction, and an adjustable trim level of at least one of the plurality of moveable motors based on an orientation characteristic.

23. The pontoon boat of claim 1, wherein a width of the pontoon boat is up to 10 feet.

24. A method of operating a pontoon boat for navigation on water, comprising the steps of:

supporting an accelerometer on the pontoon boat; and altering an output of a propulsion system of the pontoon boat based on an output of the accelerometer supported by the pontoon boat, wherein the accelerometer provides at least one of:

a lateral acceleration of the pontoon boat along an axis intersecting the port side of the pontoon boat and a starboard side of the pontoon boat; or a longitudinal acceleration of the pontoon boat along an axis intersecting a bow of the pontoon boat and a stern of the pontoon boat.

25. The method of claim 24, wherein the output of the propulsion system of the pontoon boat is altered based on the lateral acceleration indicated by the accelerometer supported by the pontoon boat.

26. The method of claim 25, wherein the output of the propulsion system of the pontoon boat is altered based on the longitudinal acceleration indicated by the accelerometer supported by the pontoon boat.

27. The method of claim 24, wherein the output of the propulsion system of the pontoon boat is altered based on the longitudinal acceleration indicated by the accelerometer supported by the pontoon boat.

28. A method of operating a pontoon boat for navigation on water, comprising the steps of:

powering movement of the pontoon boat simultaneously with a first number of motors, the first number being at least two;

detecting at least one characteristic of a first one of the first number of motors;

based on the detected at least one characteristic of the first one of the first number of motors, powering movement of the pontoon boat with a second number of motors; and controlling at least one of a trim, a steer angle, and a thrust demand for the second number of motors to maintain a desired course of the pontoon boat.

29. A method of operating a pontoon boat for navigation on water, comprising the steps of:

powering movement of the pontoon boat simultaneously with a first number of motors, the first number being at least two;

detecting at least one characteristic a power source of the pontoon boat;

based on the detected at least one characteristic of the power source, powering movement of the pontoon boat with a second number of motors, the second number being less than the first number; and controlling at least one of a trim, a steer angle, and a thrust demand for the second number of motors to maintain a desired course of the pontoon boat.

30. A method of operating a pontoon boat for navigation on water, comprising the steps of:

powering movement of the pontoon boat simultaneously with a first number of motors, the first number being at least two;

detecting at least one characteristic a power source of the pontoon boat;

determining a distance to a power supply location;

determining with an electronic controller an estimated range of the boat when powered by the first number of motors;

based on a comparison of the estimated range and the distance, powering movement of the pontoon boat with a second number of motors, the second number being less than the first number.

* * * * *